US009873259B2

(12) United States Patent
Maruyama et al.

(10) Patent No.: US 9,873,259 B2
(45) Date of Patent: Jan. 23, 2018

(54) LIQUID CONSUMPTION APPARATUS

(71) Applicant: SEIKO EPSON CORPORATION, Tokyo (JP)

(72) Inventors: Hisanori Maruyama, Fujimi-machi (JP); Junpei Yoshida, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 79 days.

(21) Appl. No.: 14/995,734

(22) Filed: Jan. 14, 2016

(65) Prior Publication Data

US 2016/0271963 A1 Sep. 22, 2016

(30) Foreign Application Priority Data

Mar. 20, 2015 (JP) ..... 2015-057512

(51) Int. Cl.
*B41J 2/175* (2006.01)
*B41J 29/13* (2006.01)

(52) U.S. Cl.
CPC ..... *B41J 2/17566* (2013.01); *B41J 2/1752* (2013.01); *B41J 2/1753* (2013.01); *B41J 2/17509* (2013.01); *B41J 29/13* (2013.01); *B41J 2002/17579* (2013.01)

(58) Field of Classification Search
USPC ..... 347/7, 85, 11, 16
See application file for complete search history.

(56) References Cited

U.S. PATENT DOCUMENTS 3,131,710 A * 5/1964 Ludwig ..... B21C 9/00 137/101.25
3,972,235 A * 8/1976 Frayer ..... G01F 23/68 73/311
4,196,625 A * 4/1980 Kern ..... B41J 2/17566 347/7
4,982,606 A * 1/1991 Adamski ..... D06F 39/087 137/387
5,250,957 A 10/1993 Onozato
5,719,556 A * 2/1998 Albin ..... G01F 23/266 340/618

(Continued)

FOREIGN PATENT DOCUMENTS

JP 03-275360 A 12/1991
JP 05-031915 A 2/1993

*Primary Examiner* — Matthew Luu
*Assistant Examiner* — Lily Kemathe
(74) *Attorney, Agent, or Firm* — Global IP Counselors, LLP

(57) ABSTRACT

A liquid consumption apparatus that detects a liquid surface level of a liquid inside a liquid container (ink tank), including: a circuit substrate; a substrate holder that holds the circuit substrate; and a control unit that detects the liquid surface level. A pair of electrically-conductive members consisting of a first electrically-conductive member and a second electrically-conductive member are provided for the liquid container. The circuit substrate is provided with a pair of terminals corresponding to the pair of electrically-conductive members. The substrate holder is provided with an elastic contact for connecting the pair of electrically-conductive members and the pair of terminals with each other. The elastic contact is a contact that is elastic in a first direction, where the first direction is a longitudinal direction of the pair of electrically-conductive members.

10 Claims, 14 Drawing Sheets

(56) References Cited

U.S. PATENT DOCUMENTS 6,164,744 A * 12/2000 Froger ..... B41J 2/1752 347/7
6,183,054 B1 * 2/2001 Froger ..... B41J 2/17566 347/7
6,185,515 B1 * 2/2001 Froger ..... B41J 2/17553 347/14
6,351,716 B1 * 2/2002 Froger ..... G01F 23/266 347/7
6,729,184 B2 * 5/2004 Tsukada ..... B41J 29/38 347/7
6,962,079 B2 * 11/2005 Eguchi ..... B41J 2/14427 73/304 R
7,086,281 B2 * 8/2006 Tsukada ..... B41J 29/38 347/68
7,131,328 B2 * 11/2006 Eguchi ..... B41J 2/14427 73/290 R
7,134,331 B2 * 11/2006 Eguchi ..... B41J 2/14427 73/290 R
7,306,308 B2 * 12/2007 Tsukada ..... B41J 2/17523 347/7
7,510,251 B2 * 3/2009 Wanibe ..... B41J 2/1753 347/7
7,568,389 B2 * 8/2009 Eguchi ..... B41J 2/14427 73/290 R
7,780,281 B2 * 8/2010 Hashimoto ..... B41J 2/17546 347/19
7,850,295 B2 * 12/2010 Hashimoto ..... B41J 2/17546 347/7
7,878,609 B2 * 2/2011 Tsukada ..... B41J 2/17513 347/7
7,880,625 B2 * 2/2011 Almoumen ..... G01F 23/0023 340/623
7,922,308 B2 * 4/2011 Wanibe ..... B41J 2/17566 347/19
7,971,945 B2 * 7/2011 Tsukada ..... B41J 2/17566 347/19
8,029,120 B2 * 10/2011 Wanibe ..... B41J 2/17559 347/19
8,061,800 B2 * 11/2011 Wanibe ..... B41J 2/17566 347/19
8,382,221 B2 * 2/2013 Frazier ..... B41J 2/17566 347/19
8,465,138 B2 * 6/2013 Hashimoto ..... B41J 2/17546 347/86
8,579,396 B2 * 11/2013 Frazier ..... B41J 2/17566 347/19
8,822,239 B2 * 9/2014 Hashimoto ..... B41J 2/17546 438/10
2003/0160835 A1 * 8/2003 Barry ..... B41J 11/0015 347/7
2005/0022595 A1 * 2/2005 Eguchi ..... B41J 2/14427 73/304 R
2005/0247127 A1 * 11/2005 Eguchi ..... B41J 2/14427 73/304 R
2007/0076023 A1 * 4/2007 Knierim ..... B41J 2/17566 347/7
2007/0103493 A1 * 5/2007 Tsukada ..... B41J 2/17509 347/7
2007/0211087 A1 * 9/2007 Hashimoto ..... B41J 2/17546 347/7
2007/0211088 A1 * 9/2007 Hashimoto ..... B41J 2/17566 347/7
2007/0211121 A1 * 9/2007 Hashimoto ..... B41J 2/17546 347/86
2009/0102870 A1 * 4/2009 Wanibe ..... B41J 2/17566 347/7
2009/0174734 A1 * 7/2009 Wanibe ..... B41J 2/17566 347/7
2009/0229376 A1 * 9/2009 Wanibe ..... B41J 2/17566 73/861.19
2009/0303060 A1 * 12/2009 Almoumen ..... G01F 23/0023 340/623
2010/0258901 A1 * 10/2010 Hashimoto ..... B41J 2/17546 257/499
2011/0234680 A1 * 9/2011 Aoyama ..... B41J 11/002 347/20
2011/0315049 A1 * 12/2011 Aoki ..... C09D 11/36 106/31.86

* cited by examiner

PWM OUTPUT 42
VDD
VSS
t1
A
t2
t3
t4

PWM OUTPUT 42
VDD
VSS
t1
T1
T2
T1

DETECTION VOLTAGE V1
VDD
VSS
Vd

ELECTRIC POTENTIAL V2
THRESHOLD VALUE
VDD
VSS

DETECTION VOLTAGE V1
VDD
VSS

OUTPUT 56
VDD
VSS

DETECTION OUTPUT 57
VDD
VSS

LIQUID CONSUMPTION APPARATUS

BACKGROUND

1. Technical Field

The present invention relates to a liquid consumption apparatus, etc.

2. Related Art

Inkjet printers are known as an example of liquid consumption apparatuses (liquid injection apparatuses). Inkjet printers can perform printing on printing media such as printing paper by ejecting ink, which is an example of a liquid, from a printing head onto the printing media. Also, inkjet printers are provided with an ink tank, which is an example of a liquid container for storing ink, and perform printing by supplying the stored ink to the printing head. Among inkjet printers of this type, some inkjet printers are known for being provided with a liquid detection unit as disclosed in JP-A-3-275360, which detects the amount of ink remaining in the ink tank, which is a kind of ink information.

In some cases, the liquid detection unit passes an electric current through the ink inside the ink tank in order to detect the amount of remaining ink. In such cases, there is the possibility of the ink being subjected to electrolysis due to the direct current passing through the ink, which leads to the occurrence of bubbles or the deposition of the ink components on the electrodes. Such a situation is problematic because the bubbles or the deposited ink components are mixed into the ink and conveyed to the printing head, clog up the nozzle of the printing head, and have a negative influence on ink ejection. The liquid detection unit according to JP-A-3-275360 is provided with a voltage limiting unit, and applies a pulse voltage also across a plurality of electrodes. Thus, JP-A-3-275360 suggests a means for detecting the amount of remaining ink while suppressing electrical energy to be applied and preventing electrolysis. However, JP-A-3-275360 does not disclose the technical concept of avoiding the negative influence of electrolysis by passing an alternating current through the ink, or any specific means for realizing the concept.

Note that an alternating current is a current with which the polarity of the voltage applied across two electrodes periodically changes with time, and the flow of the current passing between the two electrodes changes in direction along with the voltage changing. A representative example of this is a sine wave alternating current. In this specification, a sine wave alternating current and a non-sine wave alternating current are collectively referred to as an alternating current.

Regarding the case of detecting the amount of remaining ink by passing an electric current through the ink inside the ink tank, related art such as JP-A-3-275360 does not disclose a technique to appropriately position the circuit elements of a circuit substrate on which detection circuits are provided, or a technique to appropriately connect the circuit substrate to the ink tank. Note that a connection between the circuit substrate and the ink tank may be a physical connection in an appropriate relative positional relationship or an electrical connection between the circuit substrate and an electrically-conductive member (electrode rod) provided for the ink tank.

Some aspects of the invention can provide, for example, a liquid consumption apparatus that is applicable to the case of detecting a liquid surface level by using an alternating current, and in which a circuit substrate is appropriately positioned.

SUMMARY

One aspect of the invention relates to a liquid consumption apparatus that detects a liquid surface level of a liquid inside a liquid container, comprising: a circuit substrate; a substrate holder that holds the circuit substrate; and a control unit that detects the liquid surface level. The liquid container is provided with a pair of electrically-conductive members consisting of a first electrically-conductive member and a second electrically-conductive member. The circuit substrate is provided with a pair of terminals corresponding to the pair of electrically-conductive members. The substrate holder is provided with an elastic contact for connecting the pair of electrically-conductive members and the pair of terminals with each other. The elastic contact is a contact that is elastic in a first direction, where the first direction is a longitudinal direction of the first electrically-conductive member and the second electrically-conductive member.

According to one aspect of the invention, the circuit substrate is held by using the substrate holder, and the substrate holder is provided with the elastic contact. With this configuration, the circuit substrate and the substrate holder can be fixed in an appropriate positional relationship, and the displacement of the circuit substrate in the first direction can be absorbed. Accordingly, this configuration makes it possible to improve the reliability of the electrical connections between the pair of terminals and the pair of electrically-conductive members, for example.

In one aspect of the invention, each of the pair of terminals may have a circular shape.

This configuration makes it possible to improve the reliability of the electrical connections between the pair of terminals and the pair of electrically-conductive members.

In one aspect of the invention, the substrate holder may be fixed to the liquid container with a fixing member.

This configuration makes it possible to fix the substrate holder and the liquid container in an appropriate positional relationship.

In one aspect of the invention, the circuit substrate may have a regulation part that regulates a movement thereof in a direction along a plane that intersects the first direction.

This configuration makes it possible to prevent the circuit substrate from being displaced in the direction intersecting the first direction, for example.

In one aspect of the invention, the elastic contact may be attached to a contact holder, and the contact holder may be attached to the substrate holder.

This configuration makes it possible to fix the elastic contact to the substrate holder in an appropriate positional relationship.

In one aspect of the invention, the liquid container may be provided as $1^{st}$ to $k^{th}$ liquid containers, where k is an integer greater than or equal to 2. $1^{st}$ to $k^{th}$ pairs of terminals corresponding to the $1^{st}$ to $k^{th}$ liquid containers each having the pair of electrically-conductive members may be positioned on the circuit substrate. The substrate holder may be provided with $1^{st}$ to $k^{th}$ pairs of elastic contacts corresponding to the $1^{st}$ to $k^{th}$ pairs of terminals.

This configuration makes it possible to provide an appropriate number of elastic contacts corresponding to the number of pairs of electrically-conductive members and the number of pairs of terminals, for example.

In one aspect of the invention, the circuit substrate may be provided with a selection circuit for supplying an alternating current voltage to the pair of electrically-conductive members provided for a liquid container selected from among the $1^{st}$ to $k^{th}$ liquid containers.

This configuration makes it possible to appropriately detect the liquid surface levels in the plurality of liquid containers, for example.

In one aspect of the invention, the circuit substrate may be provided with at least a portion of an alternating current generation circuit configured to be able to supply an alternating current voltage to the liquid inside the liquid container via the pair of electrically-conductive members provided for the liquid container.

This configuration makes it possible to provide an alternating current generation circuit and to position at least a portion of the alternating current generation circuit on the circuit substrate.

In one aspect of the invention, the alternating current generation circuit may include: a first resistor having one end that is connected to the first electrically-conductive member; a reference electric potential supply unit that includes at least one electrical element connected between the other end of the first resistor and a reference electric potential, and that connects the first electrically-conductive member to the reference electric potential via the first resistor; and at least one capacitor connected between the second electrically-conductive member and the reference electric potential. The circuit substrate may be provided with at least the first resistor, the reference electric potential supply unit, and the capacitor.

This configuration makes it possible to realize the alternating current generation circuit that includes at least the first resistor, the reference electric potential supply unit, and the capacitor, which are provided on the circuit substrate.

In one aspect of the invention, the alternating current generation circuit may include: a periodic signal generation unit that generates a predetermined periodic signal; and a predetermined-electric potential supply unit connected to the other end of the first resistor of the alternating current generation circuit, and the predetermined-electric potential supply unit may connect the first electrically-conductive member to a predetermined electric potential that is higher than the reference electric potential via at least the first resistor during a first interval within one cycle of the predetermined periodic signal, and may disconnect a connection between the first electrically-conductive member and the predetermined electric potential during a second interval within the one cycle of the predetermined periodic signal.

This configuration makes it possible to realize the alternating current generation circuit that includes the periodic signal generation unit and the predetermined-potential supply unit.

In one aspect of the invention, the circuit substrate may be provided with a determination voltage generation unit that generates a determination voltage used for detecting the liquid surface level based on a detection voltage that is based on an electric potential of the first electrically-conductive member.

This configuration makes it possible to generate the determination voltage used for detecting the liquid surface level.

In one aspect of the invention, the determination voltage generation unit may include: a smoothing circuit that smooths the detection voltage; and a switch circuit that switches an output of the detection voltage to the smoothing circuit ON and OFF.

This configuration makes it possible to realize the determination voltage generation unit with the smoothing circuit and the switch circuit.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
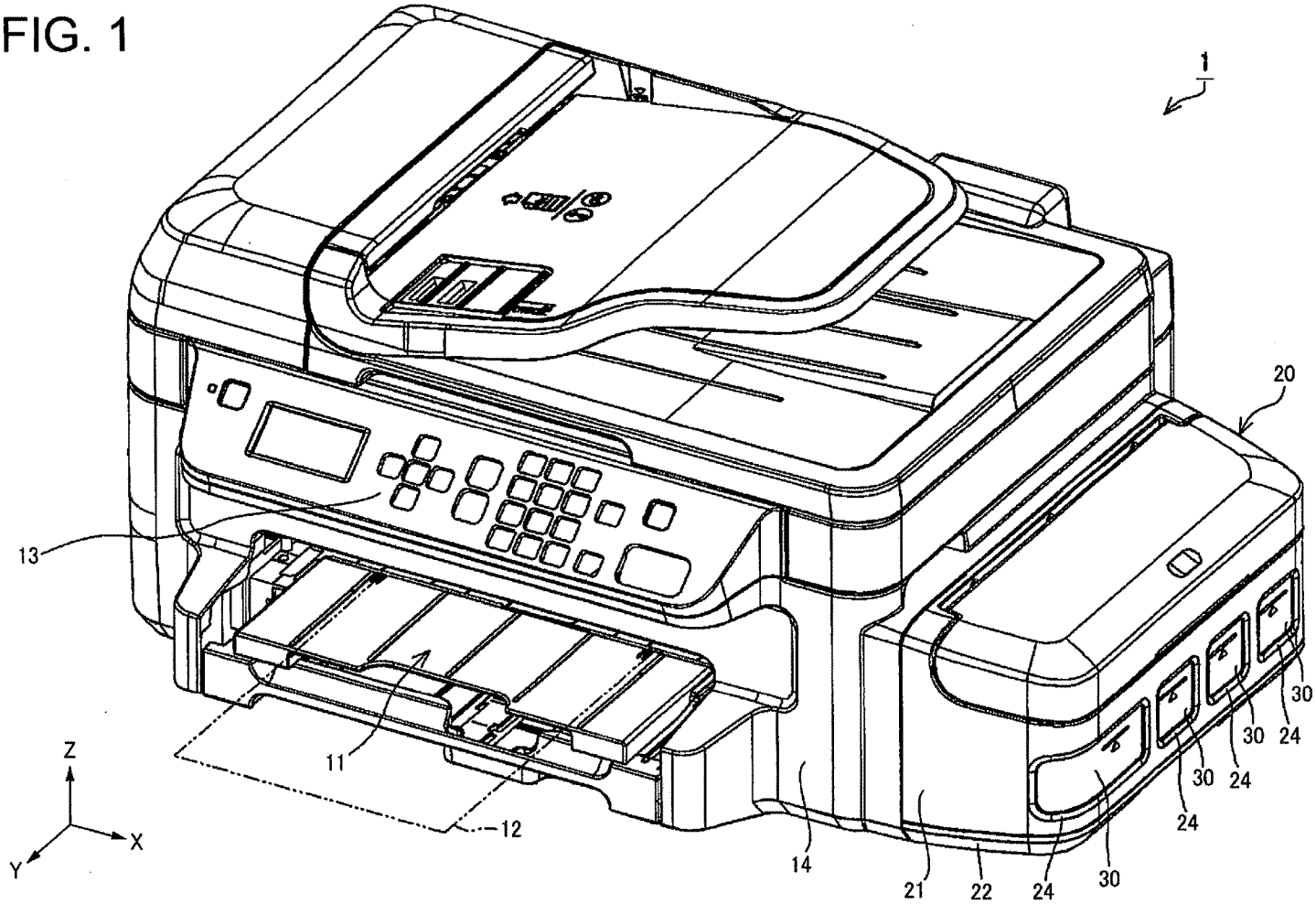
FIG. 1 is an external perspective view showing an inkjet printer according to an embodiment.

Hereinafter, an embodiment will be described. Note that the embodiment described below is not intended to unreasonably limit the contents of the invention set forth in the claims. Also, not all constituent elements described in this embodiment are essential to the invention.

1. Technique According to Present Embodiment

Hereinafter, a technique according to the present embodiment will be described. As mentioned above, great importance is attributed to the processing of liquid surface level (remaining liquid amount) detection in a liquid consumption apparatus, and more specifically, the processing of ink level detection in the ink tank of a printer. However, related art such as JP-A-3-275360 does not disclose the technical concept of avoiding the negative influence of electrolysis by passing an alternating current through the ink, or any specific means for realizing the concept.

The applicant of the invention proposes, with respect to a technique to detect the amount of remaining liquid by passing an alternating current through the liquid, a specific circuit configuration for realizing the generation of the alternating current, for example. For this purpose, the liquid consumption apparatus has a circuit substrate, on which an alternating current generation circuit is provided, for example. The liquid container is provided with, for example, an electrically-conductive member used for passing the alternating current through the liquid. The circuit substrate and the electrically-conductive member need to be electrically connected to each other.

For example, it is conceivable that a terminal is provided on the surface of the circuit substrate on the liquid container side, and the terminal and the electrically-conductive member are electrically connected. Therefore, in the liquid consumption apparatus, the circuit substrate needs to be fixed to the liquid container in a predetermined positional relationship. Otherwise, the terminal of the circuit substrate and the electrically-conductive member are not electrically connected, and there is the possibility that the detection of the amount of remaining ink (the detection of the liquid surface level) cannot be properly performed. Note that the terminal and the electrically-conductive member are not necessarily in direct contact, and may be connected via, for example, an elastic contact 273, which is described below with reference to FIG. 7.

Considering the above, the applicant of the invention proposes, as described below with reference to FIG. 1 and FIG. 2 for example, a liquid consumption apparatus that detects a liquid surface level of ink (the amount of remaining ink) inside a liquid container (corresponding to an ink tank 30 described below). The liquid consumption apparatus includes: a circuit substrate 26; a substrate holder 27 that holds the circuit substrate 26; and a control unit 16 that detects the liquid surface level. In the liquid consumption apparatus according to the present embodiment, the liquid container is provided with a pair of electrically-conductive members consisting of a first electrically-conductive member 35 and a second electrically-conductive member 36, the circuit substrate 26 is provided with a pair of terminals (a first terminal 38 and a second terminal 39) corresponding to the pair of electrically-conductive members, the substrate holder 27 is provided with an elastic contact 273 for connecting the pair of electrically-conductive members and the pair of terminals with each other, and the elastic contact is a contact that is elastic in a first direction, where the first direction is a longitudinal direction of the first electrically-conductive member 35 and the second electrically-conductive member 36. Note that the longitudinal direction in this case is the longitudinal direction of the first electrically-conductive member and the second electrically-conductive member when the liquid container has been disposed in a liquid injection apparatus and the liquid injection apparatus in its available state.

The liquid consumption apparatus according to the present embodiment has the substrate holder 27, and the circuit substrate 26 is held (fixed) by the substrate holder. Therefore, with the substrate holder 27, compared to the case where the circuit substrate 26 alone is to be fixed to the liquid container, it is possible to reliably fix the circuit substrate 26 to a desired position within the liquid consumption apparatus. This configuration can improve the reliability of the electrical connections between the pair of terminals of the circuit substrate 26 and the pair of electrically-conductive members provided for the liquid container, and consequently makes it possible to perform appropriate liquid surface level detection.

However, even if such fixing is performed, a tiny displacement cannot be prevented due to a mechanical tolerance for manufacturing or assembly. Then, when a gap occurs below the circuit substrate 26, that is, if the circuit substrate 26 (specifically, the pair of terminals 38 and 39) is located further in the positive Z axis direction of the ink tank 30 than envisioned, a possibility arises in which the pair of terminals and the pair of electrically-conductive members will not be electrically connected. Note that the setting of the coordinate system is described later with reference to FIG. 1 and so on.

In this case, the first terminal 38 and the second terminal 39 are isolated from each other, and this situation is similar to the situation in which the resistance between the first electrically-conductive member 35 and the second electrically-conductive member 36 is very large. In this case, it is determined that the amount of remaining ink is small regardless of the actual amount of remaining ink (the details are described later with reference to Part G of FIG. 14, etc.), which is a significant problem.

Therefore, according to the present embodiment, the pair of terminals and the pair of electrically-conductive members are respectively connected by using the elastic contact 273, and the elastic contact is elastic in the first direction (Z axis direction). With this configuration, even when a displacement in the Z axis direction occurs, the elastic contact 273 can absorb the displacement, and this makes it possible to further improve the reliability of the electrical connections between the pair of terminals and the pair of electrically-conductive members.

Hereinafter, a specific technique according to the present embodiment will be described. First, a description is given of an example of the outline of the configuration of the liquid consumption apparatus, and then a description is given of the details of the technique of detecting the liquid surface level. Note that the configuration of a liquid detection unit 60 that performs liquid surface level detection and an example of the positions of the circuit elements and the terminal of the circuit substrate 26 are described in the description of the technique of detecting the liquid surface level. Some modification examples are described at the end.

2. Example of Outline of Configuration of Liquid Consumption Apparatus

The following describes an inkjet printer 1 (hereinafter referred to as "the printer"), which is an example of a liquid consumption apparatus to which the present embodiment has been applied. The printer 1 performs printing on printing media such as paper 12 by ejecting ink 34, which is stored in an ink tank 30, from a printing head 17 onto the printing media (see FIG. 1 and FIG. 3). Here, the ink tank 30 corresponds to a liquid container, and the ink 34 corresponds to the liquid stored in the liquid container. Note that the vertical and horizontal scales of members and portions in the drawings referred to in the following description may differ from the actual scales in order to simplify the description and the drawings. Also note that although the following describes an example in which a plurality of ink tanks 30 are provided, the liquid consumption apparatus is not limited to this example, and the liquid consumption apparatus according to the present embodiment may be configured to have a single ink tank 30 (liquid container).

2.1 Example of Overall Configuration

First, a description is given of the overall configuration of the printer 1 with reference to FIG. 1. FIG. 1 is an external perspective view of the printer 1 according to the present embodiment. FIG. 1 shows an X axis, a Y axis, and a Z axis, which are coordinate axes orthogonal to each other. The drawings referred to below are also provided with the same X axis, Y axis, and Z axis as necessary. For each of the X, Y, and Z axes, the direction indicated by the arrow indicates the + (positive) direction, and the direction opposite to the direction indicated by the arrow indicates the − (negative) direction. When the printer 1 is in the usage state, the printer 1 is disposed on the horizontal plane defined by the X axis and the Y axis. When the printer 1 is in the usage state, the Z axis is an axis that is orthogonal to the horizontal plane, and the −Z axis direction coincides with the vertical downward direction. The surface of the printer 1 in the +Y axis direction is referred to as the front surface, and the surface in the −Y axis direction is referred to as the back surface.

As shown in FIG. 1, the printer 1, which is a liquid consumption apparatus according to the present embodiment, includes an ink tank unit 20, an operation unit 13, and a paper discharge unit 11. The printer 1 also includes a casing 14, and the casing 14 constitutes a portion of the outer shell of the printer 1. A machinery unit (not shown in the drawings) of the printer 1 is housed inside the casing 14. The machinery unit is a machinery portion of the printer 1 that executes a printing operation.

The ink tank unit 20 includes an ink tank unit covering 21 and an ink tank unit bottom part 22, and is installed outside the casing 14. The ink tank unit 20 can house a plurality of ink tanks 30. The ink tanks 30 store ink 34 used for printing, and when the printer 1 performs printing, the ink 34 is supplied from the ink tanks 30 to the printing head 17 (see FIG. 3).

At least a portion of each ink tank 30 is formed from light-transmissive material, so that the ink 34 stored therein can been seen from the outside. The ink tank unit covering 21 has light-transmissive windows parts 24, which are respectively located in positions facing the light-transmissive portions of the ink tanks 30 housed therein. Therefore, the user can visually check the amount of the ink 34 in each ink tank 30 from the outside of the printer 1 via the corresponding window part 24.

The operation unit 13 and the paper discharge unit 11 are positioned on the front surface of the printer 1. The operation unit 13 is provided with a power button, a setting button, a display panel, etc. The printer 1 includes a control unit 16, which is mounted on a control substrate 15 (see FIG. 3). The control unit 16 causes the above-described machinery unit to operate based on an instruction or the like input from the operation unit 13, to convey the paper 12, drive the printing head 17, and perform printing on the paper 12. The paper 12 on which printing has been performed is discharged from the paper discharge unit 11.

2.2 Example of Configuration of Ink Tank Unit

Figure 2:
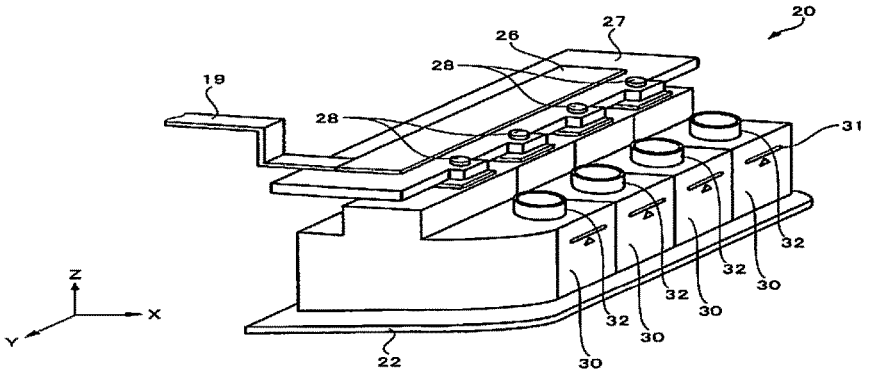
FIG. 2 is a perspective view showing an ink tank unit part from which an ink tank unit covering has been removed.

Next, a description is given of a configuration of the ink tank unit 20 with reference to FIG. 2. FIG. 2 is a perspective view showing the ink tank unit 20 from which the ink tank unit covering 21 has been removed.

As shown in FIG. 2, the ink tank unit 20 includes the ink tank unit bottom part 22. The ink tank unit 20 also includes a substrate holder 27 located in the vertical upward direction (+Z axis direction) of the ink tank unit 20, with a space therebetween in which the ink tanks 30 are positioned. Furthermore, the ink tank unit 20 includes the ink tank unit covering 21 that surrounds the ink tanks 30 which have been attached. The ink tank unit bottom part 22 and the substrate holder 27 are fixed to the printer 1 before installation.

A plurality of ink tanks 30 can be attached to the ink tank unit 20 so as to face the ink tank unit bottom part 22. In the present embodiment, four ink tanks 30 are attached. Each of the four ink tanks 30 stores a different type of the ink 34 (with a different color, material, etc.). One of the four ink tanks 30 is greater in size than the rest, and can store a larger amount of the ink 34. Considering the above, for example it is possible to use the ink tank 30 having a large size to store the ink 34 of the color black, which is frequently used, and use the other ink tanks 30 to separately store the inks 34 of the color yellow, magenta, and cyan.

The substrate holder 27 in the vertical upward direction of the ink tank unit bottom part 22 is positioned to come into contact with the ink tanks 30 when the ink tanks 30 are positioned and attached to the ink tank unit 20. The ink tanks 30 are thus positioned in the ink tank unit 20 so as to be sandwiched between the ink tank unit bottom part 22 and the substrate holder 27.

The ink tanks 30 are fixed to the substrate holder 27 with screws 28. The substrate holder 27 has a circuit substrate 26, on which circuitry including an alternating current generation circuit 40 (see FIG. 11), which is described below, is mounted. Thus, when the ink tanks 30 are fixed to the substrate holder 27, the ink tanks 30 are fixed to the circuit substrate 26 as well. Signal wiring FFC (Flexible Flat Cable) 19 is connected to the circuit substrate 26, and the circuitry mounted on the circuit substrate 26 and the circuitry mounted on the control substrate 15 of the printer 1 are electrically connected (see FIG. 3). Note that the ink tanks 30 come into contact with the substrate holder 27 and the circuit substrate 26 at regions aside from ink injection ports 32 (their details are described below) of the ink tanks 30.

2.3 Example of Configuration of Ink Tank

Figure 3:
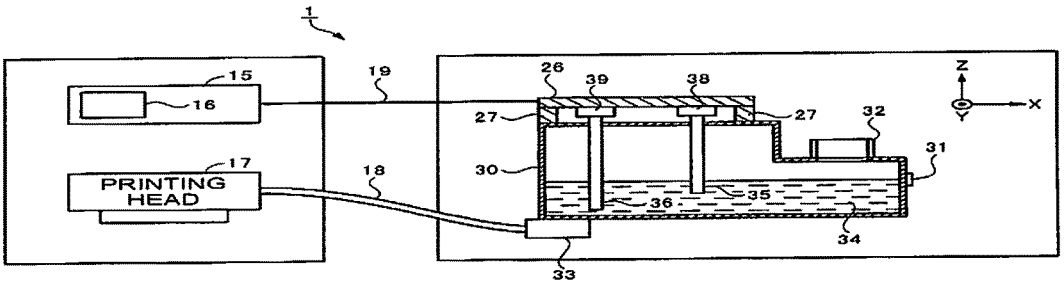
FIG. 3 is a schematic diagram showing a configuration of an ink tank and a relationship between the ink tank and other constituent elements of the inkjet printer.

Next, a description is given of a configuration of each ink tank 30 and its connection to the printer 1 with reference to FIG. 2 and FIG. 3. FIG. 3 is a schematic diagram showing the configuration of the ink tank 30 and the relationship between the ink tank 30 and other constituent elements of the printer 1.

As shown in FIG. 3, the ink tank 30 is a hollow container, and can store the ink 34 in the hollow part. The ink tank 30 has the ink injection port 32 in its surface in the vertical upward direction (+Z axis direction), from which the ink 34 can be injected (see FIG. 2 and FIG. 3). Therefore, it is possible to refill the ink tank 30 with the ink 34 from the ink injection port 32 when the amount of the ink 34 stored becomes low. Usually, a cap member (not shown in the drawings) is attached to the opening of the ink injection port 32 so as to be air tight. The user of the printer 1 can remove the cap member and refill the ink tank 30 with the ink 34 via the ink injection port 32.

Each ink tank 30 is defined by an outer wall, which is at least partially light-transmissive. In the present embodiment, a portion of the outer wall in the +X axis direction is light-transmissive. This outer wall surface has a mark 31 (see FIG. 2), which roughly indicates the amount of ink. The user can know the amount of ink by using the mark 31 as a guide.

The ink tank 30 also has an ink supply part 33, which sends the ink 34 stored therein to the printing head 17.

The ink tank 30 also has a pair of electrically-conductive members (electrodes, electrode rods) consisting of the first electrically-conductive member 35 and the second electrically-conductive member 36. The first electrically-conductive member 35 and the second electrically-conductive member 36 project to the outside of the ink tank 30, and are positioned in a region that is in contact with the substrate holder 27, particularly a region that is in contact with the circuit substrate 26.

The first electrically-conductive member 35 and the second electrically-conductive member 36 are each manufactured from a stainless material having the shape of a flattened rod extending from the outside of the ink tank 30 into the hollow part. The length of the first electrically-conductive member 35 is shorter than the length of the second electrically-conductive member 36. The second electrically-conductive member 36 extends further than the end of the first electrically-conductive member 35, reaching the vicinity of the bottom of the hollow part. Thus, at least when the ink 34 fills the hollow part, both of the electrodes, namely the first electrically-conductive member 35 and the second electrically-conductive member 36, are immersed in the ink 34. Then, after printing is performed, the ink 34 is consumed, and the amount of ink decreases, the first electrically-conductive member 35 is exposed to the outside of the ink 34, and only the second electrically-conductive member 36 is immersed in the ink 34.

As described above, the ink tanks 30 are positioned in the ink tank unit 20 so as to be sandwiched between the ink tank unit bottom part 22 and the substrate holder 27. The circuit substrate 26 is positioned on the substrate holder 27 so as to face, and so as to be contactable with, the first electrically-conductive member 35 and the second electrically-conductive member 36 of the ink tank 30. A pair of terminals consisting of a first terminal 38 and a second terminal 39 are formed at positions of the circuit substrate 26 that face the first electrically-conductive member 35 and the second electrically-conductive member 36. Thus, when the ink tank 30 is positioned in the ink tank unit 20, the first electrically-conductive member 35 and the first terminal 38 are brought into contact and electrically connected, and the second electrically-conductive member 36 and the second terminal 39 are brought into contact and electrically connected.

Also, due to the substrate holder 27 and the ink tank 30 being fixed to each other with a screw 28, the first electrically-conductive member 35 is joined to the first terminal 38 by pressure, and the second electrically-conductive member 36 is joined to the second terminal 39 by pressure. The electrical connections of the electrically-conductive members 35 and 36 and the terminals 38 and 39 are thus reliably established.

Furthermore, the circuitry mounted on the circuit substrate 26 and the circuitry mounted on the control substrate 15 of the printer 1 are connected to each other via the signal wiring FFC 19. The circuitry mounted on the control substrate 15 includes the control unit 16, and accordingly the circuitry on the circuit substrate 26 can perform mutual communication with the control unit 16.

Also, the ink 34 has electrical conductivity with an ink resistance value Ri (see FIG. 13), which is based on the material and the composition thereof. Therefore, when both of the electrodes, namely the first electrically-conductive member 35 and the second electrically-conductive member 36, are immersed in the ink 34, the first electrically-conductive member 35 and the second electrically-conductive member 36 are electrically connected via the ink 34.

The ink supply part 33 is provided in a position corresponding to the lower part of the ink tank 30 when the ink tank 30 is in use. The ink 34 injected from the ink injection port 32 to the ink tank 30 is stored in the hollow part, and is sent to the outside from the ink supply part 33. A tube 18, which serves as an ink transport passage, is positioned by being fixed to the printer 1. One end of the tube 18 is connected to the ink supply part 33, and the other end of the tube 18 is connected to the printing head 17. Thus, the ink 34 in the ink tank 30 is transported to the printing head 17 via the tube 18 and is used for printing.

The ink tank unit 20 is configured such that the ink supply part 33 joins to the tube 18 when the ink tank 30 is positioned.

As described above, when the ink tank 30 is attached to the ink tank unit 20, the ink supply part 33 is joined to the tube 18, and the first electrically-conductive member 35 and the second electrically-conductive member 36 are electrically connected to the first terminal 38 and the second terminal 39 on the circuit substrate 26. Thus, the ink 34 stored in the ink tank 30 is brought into the state of being able to be used in the printer 1.

2.4 Substrate Holder and Elastic Contact

As described above, the liquid consumption apparatus includes the substrate holder 27 as shown in FIG. 2, in order for the circuit substrate 26 and the liquid container to be physically fixed to each other and the pair of terminals (38 and 39) and the pair of electrically-conductive members (35 and 36) to be electrically connected to each other in a reliable manner. The following describes the details of the substrate holder 27 and the elastic contact 273 provided in the substrate holder 27, with reference to FIG. 4A to FIG. 9B.

The outline of the substrate holder 27 is as shown in FIG. 2. The circuit substrate 26 is fixed to the substrate holder 27. Furthermore, the substrate holder 27 is fixed to the ink tank 30, and accordingly the circuit substrate 26 (more specifically, the pair of terminals) and the ink tank 30 (more specifically, the pair of electrically-conductive members) are fixed to each other in an appropriate positional relationship.

Figure 4B:
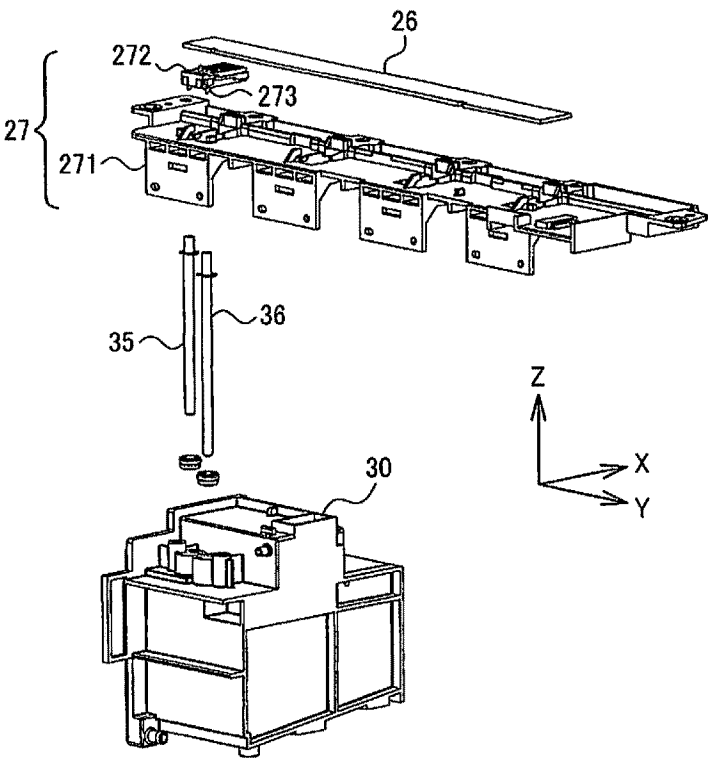
FIG. 4A and FIG. 4B are external perspective views of a substrate holder.
Figure 4A:
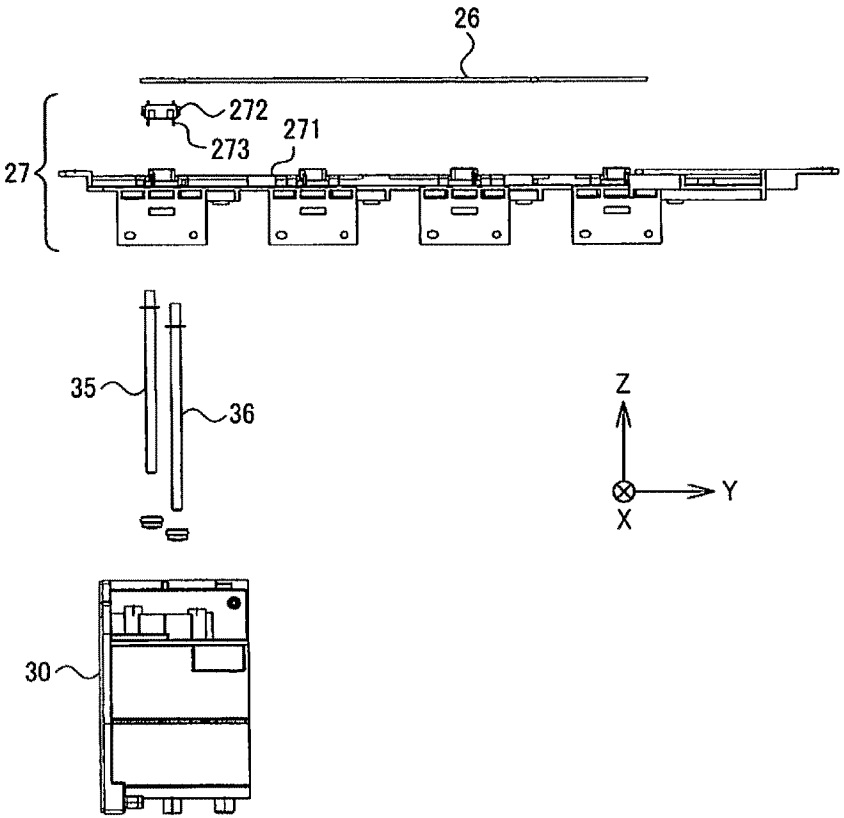

Specific external perspective views of the substrate holder 27 are shown in FIG. 4A and FIG. 4B. As shown in FIG. 4A and FIG. 4B, the substrate holder 27 includes a main body part 271 and a contact holder 272, and the contact holder 272 is provided with the elastic contact 273. The main body part 271 is a plate-shaped member that has at least a member that extends along the XY plane direction in the state after the completion of assembly, and the length of the main body part 271 in the Y axis direction (the longitudinal direction of the circuit substrate 26) is longer than the length of the circuit substrate 26. The substrate holder 27 supports the circuit substrate 26 by the main body part 271. The main body part 271 is made of, for example, synthetic resin such as nylon or polypropylene. Note that FIG. 4A and FIG. 4B also serve as exploded diagrams illustrating the connection relationship between the substrate holder 27 and other members (such as the circuit substrate 26 and the ink tank 30).

Figure 5:
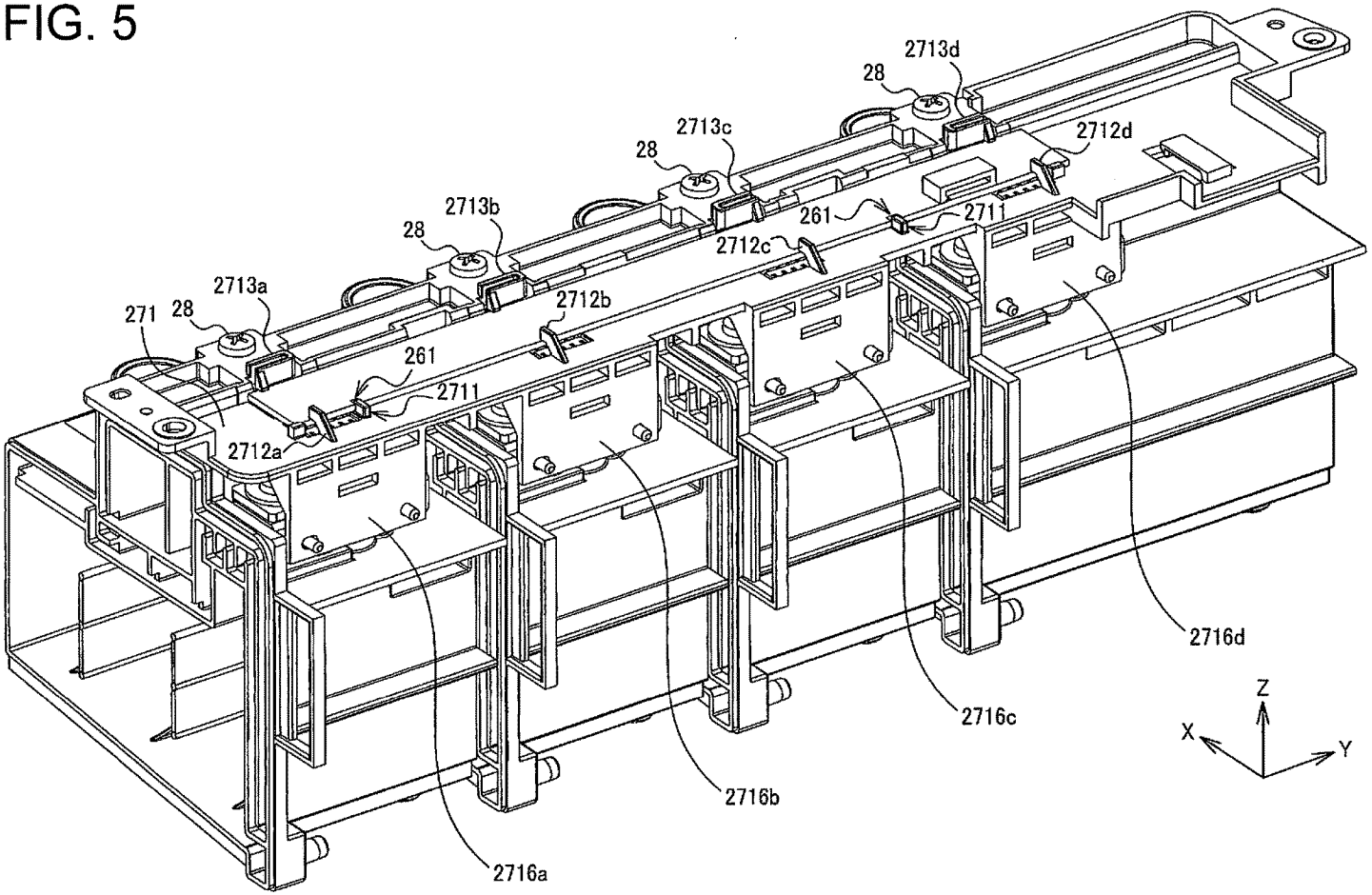
FIG. 5 is an external perspective view of the substrate holder, etc., after the completion of assembly.
Figure 6:
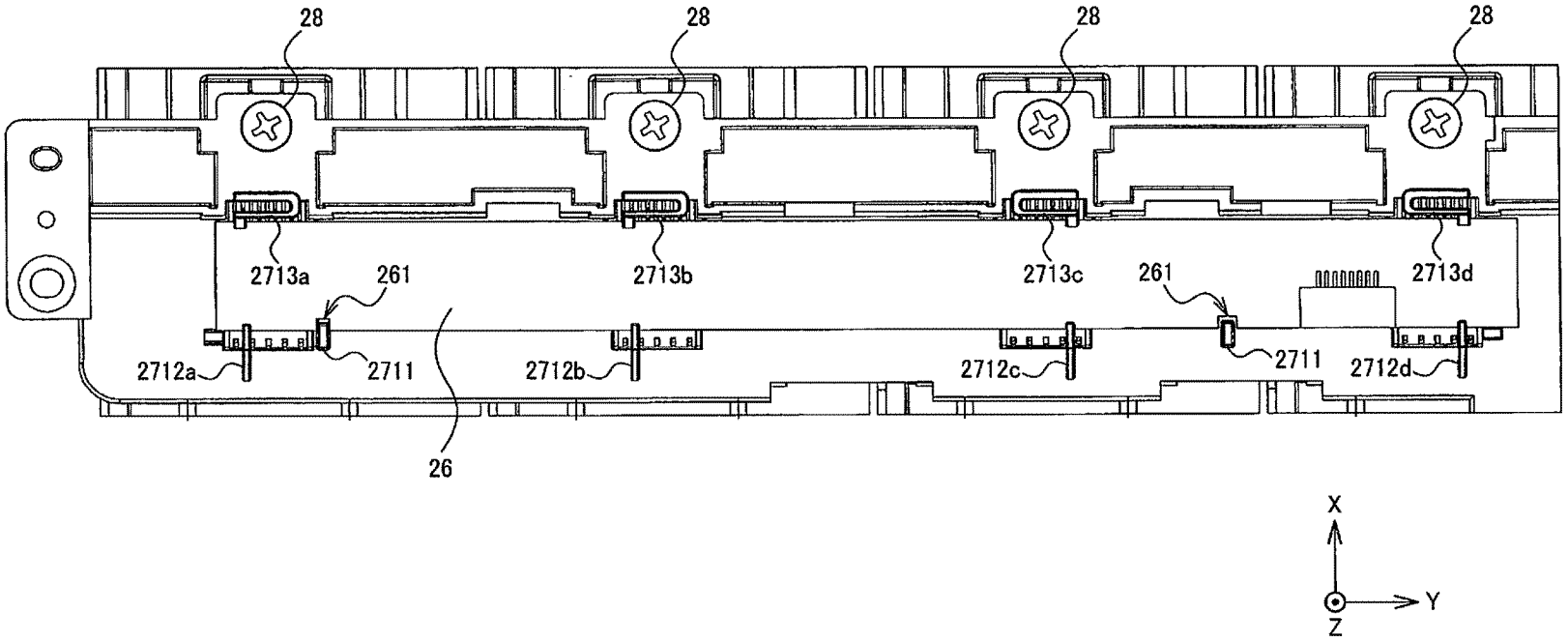
FIG. 6 is a plan view of the substrate holder, etc., after the completion of assembly.

The circuit substrate 26 also has a regulation part that regulates its movement in the direction along the plane (the XY plane) intersecting a first direction (the Z axis direction). The regulation part may be embodied in various forms, and for example, may be a recessed part 261 (a cutaway part) as shown in FIG. 5 and FIG. 6 (or FIG. 10A and FIG. 10B described below). FIG. 5 is an external perspective view of the ink tank and the substrate holder 27 after the completion of assembly, and FIG. 6 is a plan view of the substrate holder 27 when viewed from above (when viewed in the negative Z axis direction from a viewpoint that is set in the positive Z axis direction) after the completion of assembly.

A projection part 2711 is provided on the main body part 271 of the substrate holder 27, and the recessed part 261 and the projection part 2711 engage with each other in the state where the circuit substrate 26 is fixed to the substrate holder 27. In other words, during assembly, first, the recessed part 261 and the projection part 2711 are engaged with each other, and then the circuit substrate 26 is fitted into holder-side first regulation parts 2712 (2712*a* to 2712*d*) and holder-side second regulation parts 2713 (2713*a* to 2713*d*), which are provided on the main body part 271 of the substrate holder 27 and regulate the movement of the circuit substrate 26 at least in the first direction (the Z axis direction), and thus the circuit substrate 26 is fixed to the substrate holder 27. The holder-side first regulation parts 2712 and the holder-side second regulation parts 2713 are engaging claws that regulate the movement of the circuit substrate 26 by engaging with the outer periphery of the circuit substrate 26.

Note that in the example shown in FIG. 5 and FIG. 6, the holder-side second regulation parts 2713 each have a U-shaped configuration, so that they can expand and contract in the X axis direction. Therefore, it is easy to attach or detach the circuit substrate 26 by applying a force in the X axis direction to the holder-side second regulation parts 2713. In FIG. 5 and FIG. 6 particularly, the holder-side second regulation parts 2713 each have a sloped surface whose normal vector is directed in the resultant vector direction obtained by combining the positive X axis direction vector and the positive Z axis direction vector, and the sloped surfaces are provided in positions that come into contact with the circuit substrate 26 at the time of attachment. Due to these sloped surfaces, a force in the X axis direction can be spontaneously applied to the holder-side second regulation parts 2713 by an operation to apply a force from the positive Z axis direction, that is, an operation to push the circuit substrate 26 from the positive Z axis direction to the negative direction. This makes it easy to attach the circuit substrate 26.

The substrate holder 27 is fixed to the liquid containers (ink tanks 30) with the fixing members. The fixing members are the screws 28. In this way, the circuit substrate 26 and the substrate holder 27 are fixed by using the regulation parts and so on, and the substrate holder 27 and the ink tanks 30 are fixed with the fixing members. As a result, it is possible to fix the circuit substrate 26 to the ink tanks 30 (more specifically, the pairs of electrically-conductive members) in an appropriate positional relationship.

Also, as described above, in the liquid consumption apparatus according to the present embodiment, the elastic contacts 273 are provided so that the pairs of terminals and the pairs of electrically-conductive members are electrically connected even when a displacement in the Z axis direction occurs with respect to the circuit substrate 26 and any of the ink tanks 30.

For example, in the case where $1^{st}$ to $k^{th}$ liquid containers (k is an integer greater than or equal to 2) are provided in the liquid consumption apparatus according to the present embodiment, $1^{st}$ to $k^{th}$ pairs of terminals that respectively correspond to the $1^{st}$ to $k^{th}$ liquid containers each having a pair of electrically-conductive members are positioned on the circuit substrate 26, and $1^{st}$ to $k^{th}$ pairs of elastic contacts that respectively correspond to the $1^{st}$ to $k^{th}$ pairs of terminals are provided on the substrate holder 27.

With this configuration, it is possible to provide an appropriate number of elastic contacts 273 according to the number of liquid containers, thereby improving the reliability of the electrical connections between the electrically-conductive members provided for each liquid container and the circuit substrate 26.

Figure 7:
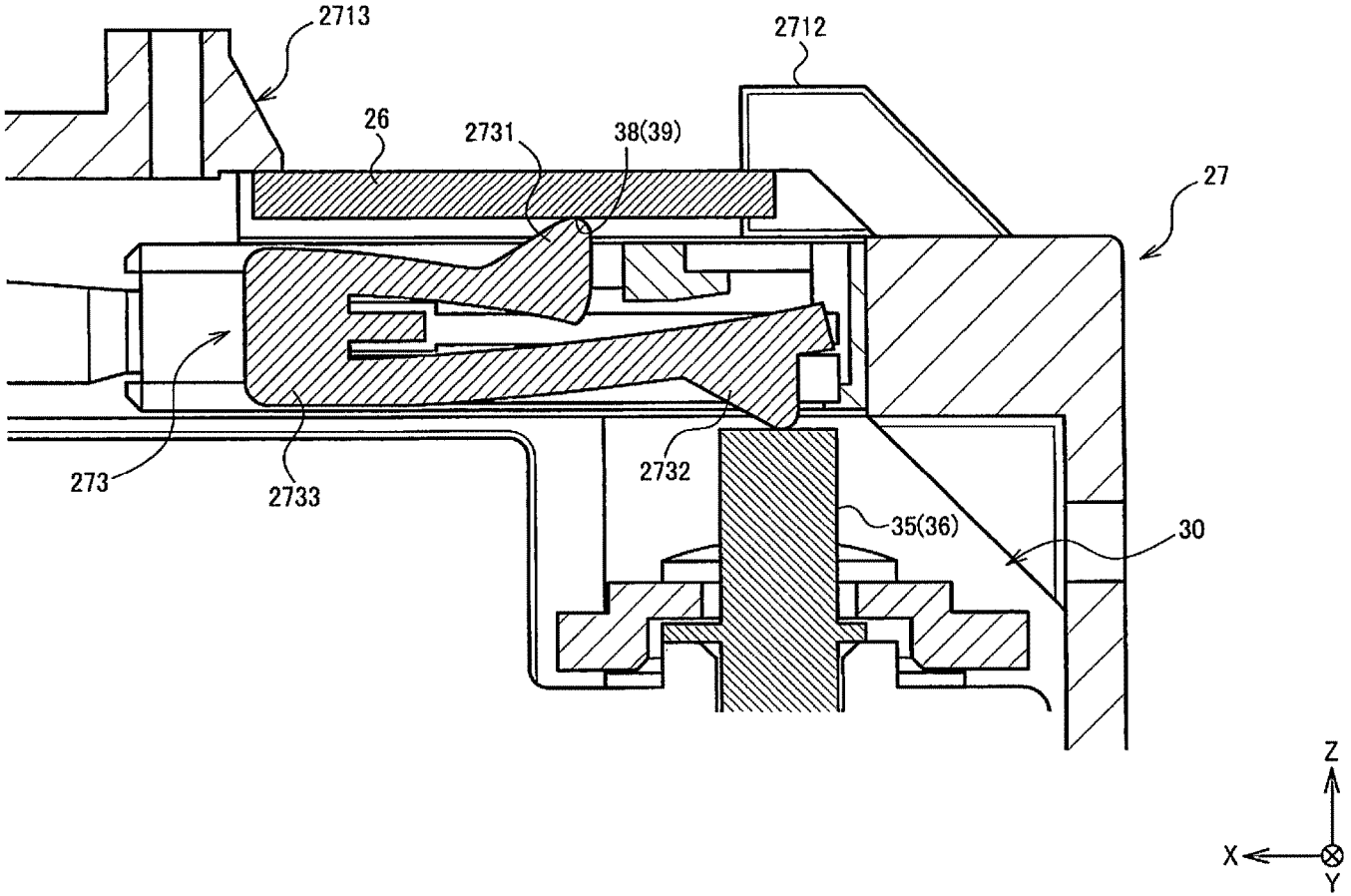
FIG. 7 is a cross-sectional view of an elastic contact.

A specific example of the elastic contact 273 is shown in FIG. 7. FIG. 7 is a cross-sectional view of the pair of electrically-conductive members, the substrate holder 27, and the circuit substrate 26 along the XZ plane after the completion of assembly. As shown in FIG. 7, the elastic contact 273 has a first projection part 2731 that comes in contact with a terminal of the circuit substrate 26, and a second projection part 2732 that comes in contact with an electrically-conductive member provided on an ink tank 30. The first projection part 2731 and the second projection part 2732 are connected via a plate-shaped electrically-conductive member 2733. Note that since the elastic contact 273 is for realizing electrical connection, the first projection part 2731, the second projection part 2732, and the plate-shaped electrically-conductive member 2733 are made of electrically-conductive material such as metal. Note that a single elastic contact 273 is connected to either one of the pair of terminals (38 and 39) by the first projection part 2731, and is connected to either one of the pair of electrically-conductive members (35 and 36) by the second projection part 2732, and thus electrically connects the aforementioned one terminal and the aforementioned one electrically-conductive member. In other words, a pair of contacts are used for connecting a pair of terminals and a pair of electrically-conductive members.

The plate-shaped electrically-conductive member 2733 of the elastic contact 273 is configured to be elastically deformable in the Z axis direction by bending like a leaf spring, as shown in FIG. 7. In other words, when the longitudinal direction of the first electrically-conductive member 35 and the second electrically-conductive member 36 is referred to as a first direction, the $1^{st}$ to $k^{th}$ pairs of elastic contacts are elastically deformable in the first direction (Z axis direction).

Note that although FIG. 7 illustrates the shape of the cross-section of a single elastic contact 273, a pair of elastic contacts are used for electrically connecting a pair of terminals and a pair of electrically-conductive members. Similarly, when k pairs of terminals and k pairs of electrically-conductive members are provided, k pairs of elastic contacts 273, namely 2k elastic contacts 273, are accordingly provided. In these cases, the shape of each elastic contact 273 may be the same as that in FIG. 7.

With this configuration, even when the positional relationship in the Z axis direction is changed to some extent due to, for example, a gap occurring below the circuit substrate 26, a high degree of contact between the pair of terminals and the pair of electrically-conductive members is maintained, and the reliability of the electrical connections can be thus improved. When the distance in the Z axis direction between the circuit substrate 26 and the ink tank 30 is shorter than envisioned, an excessive pressing force is applied to the circuit substrate 26, which leads to the problem of the circuit substrate 26 deforming. However, the above-described configuration can also prevent the circuit substrate 26 from deforming.

Figure 8A:
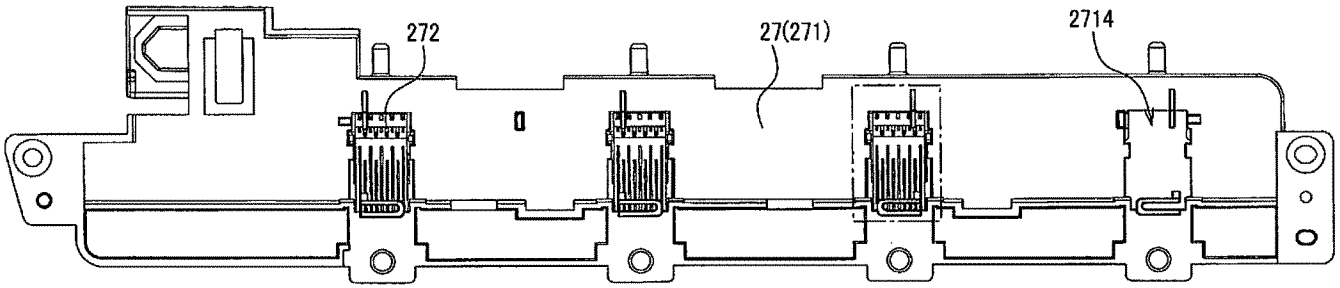
FIG. 8A and FIG. 8B are plan views of a contact holder, etc.
Figure 8B:
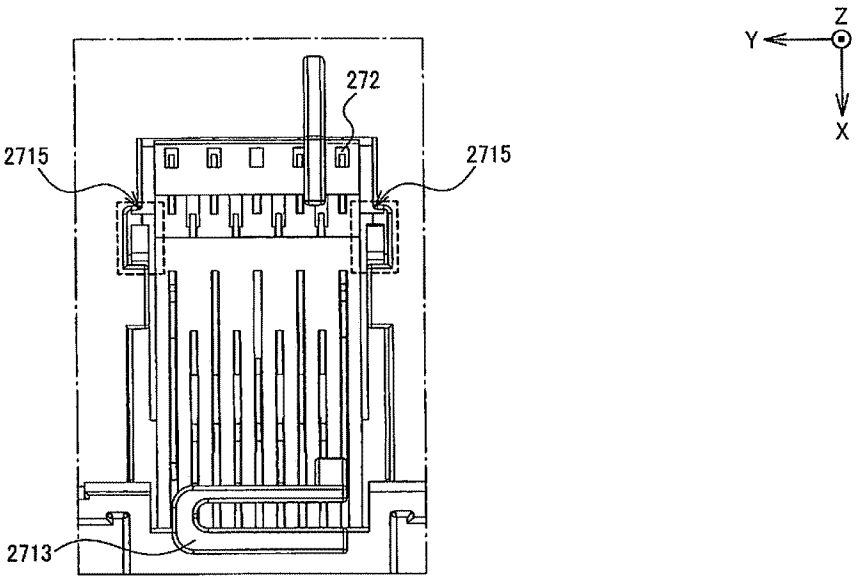
Figure 9A:
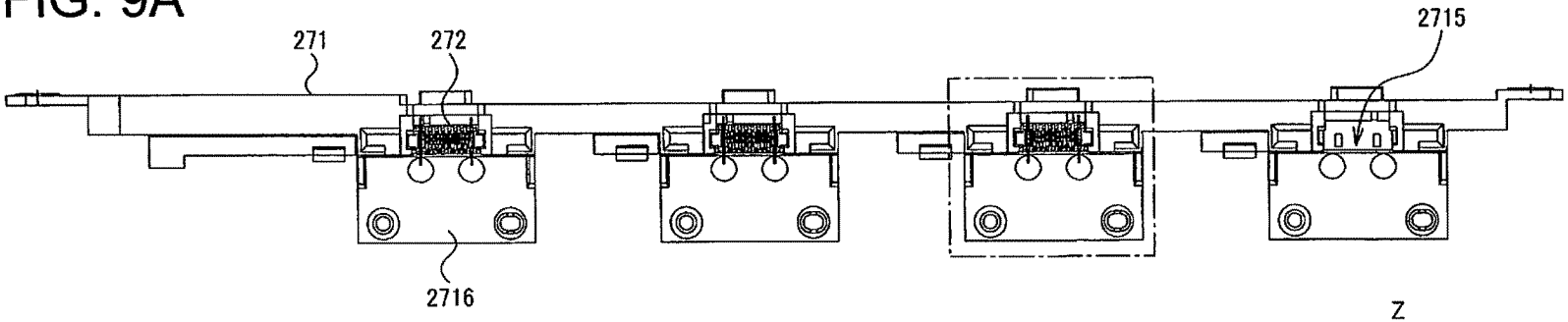
FIG. 9A and FIG. 9B are cross-sectional views of the contact holder, etc.
Figure 9B:
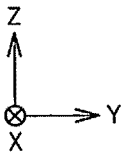
Figure 9B:
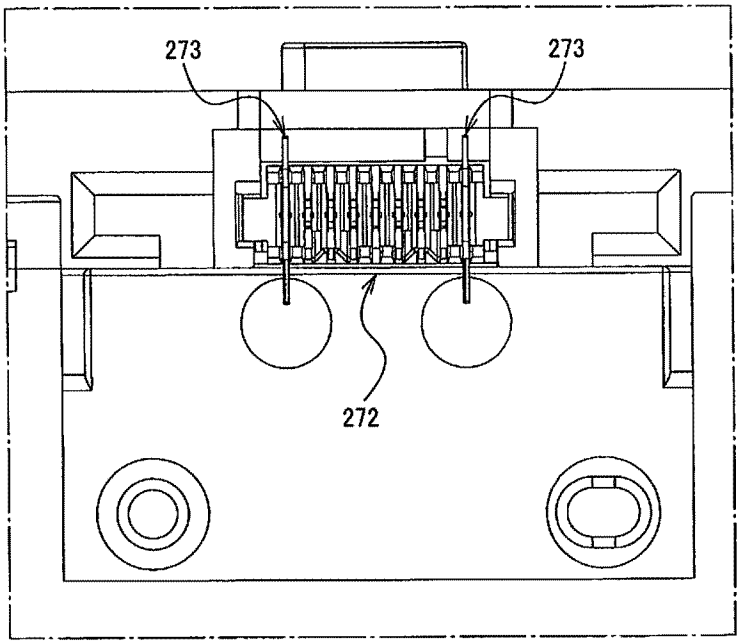

Note that the $1^{st}$ to $k^{th}$ pairs of elastic contacts are provided on the substrate holder 27. For example, each pair of elastic contacts is attached to the contact holder 272, and the contact holder 272 is attached to the substrate holder 27 (more specifically, the main body part 271 of the substrate holder 27). A plan view (a view from the Z axis direction) and a cross-sectional view (a view from the X axis direction) of the contact holder 272 in the state of being attached to the main body part 271 are respectively shown in FIG. 8A and FIG. 9A. FIG. 8B and FIG. 9B are enlarged views of FIG. 8A and FIG. 9A, respectively. Note that the number of contact holders 272 to be provided corresponds to the number of ink tanks 30. In FIG. 4A and FIG. 4B, the contact holders 272 other than one contact holder 272 are omitted in order to simplify the description, and in FIG. 8A and FIG. 9A, the rightmost contact holder 272 is omitted in order to clearly show a fitting hole 2714. However, in the case of the printer 1 having four ink tanks 30, four contact holders 272 are to be provided.

As shown in FIG. 8A to FIG. 9B, the main body part 271 has the fitting holes 2714, and the contact holders 272 are respectively inserted into the fitting holes 2714. Note that a snap-fit part 2715 shown in FIG. 8B, for example, may be used for fixing a contact holder 272 to a fitting hole 2714.

Each contact holder 272 has a plurality of groove parts extending along the XZ plane. In the example shown in FIG. 9B, a single pair of elastic contacts 273 are provided in the rightmost and leftmost of the grooves. However, the shapes of the contact holders 272 and the elastic contacts 273, and the technique to fix the elastic contacts 273 to the contact holders 272, are not limited to the description above, and various modifications may be adopted. The configuration above makes it possible to appropriately fix the elastic contacts 273 to the substrate holders 27, and accordingly makes it possible to further improve the reliability of the electrical connections between the pairs of terminals and the pairs of electrically-conductive members.

A plurality of protection wall parts 2716 (four protection wall parts 2716*a* to 2716*d* in the examples in FIG. 5A and so on) are provided at the end portion of the substrate holder 27 (particularly the main body part 271) in the negative X-axis direction. Each of the protection wall parts 2716, which are formed to hang in the vertical direction in the position facing the corresponding ink tank 30, is, in a view in the X axis direction, located to overlap the connection area in which the pair of terminals (38 and 39), the elastic contact 273, and the pair of electrically-conductive members (35 and 36) are connected. Due to each protection wall parts 2716 of the substrate holder 27, the connection area above can be protected from, for example, the intrusion of a foreign object.

Although the displacement in the Z axis direction is considered above as the displacement due to a mechanical tolerance, the displacement due to a mechanical tolerance may occur in the direction along the XY plane. Therefore, it is preferable that a configuration is adopted in which the reliability of the electrical connections between the pairs of terminals and the pairs of the electrically-conductive members can be improved, even if this displacement occurs.

Figure 10A:
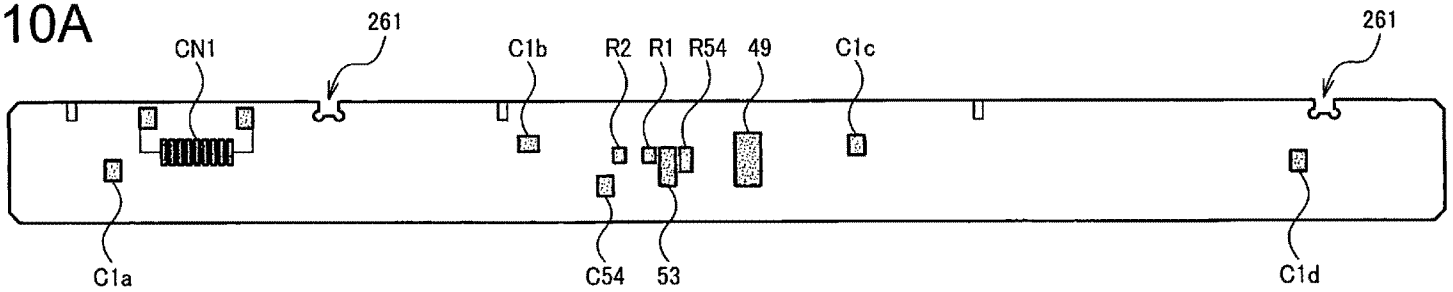
FIG. 10A shows an example of positions of circuit elements on a second surface of the circuit substrate.
Figure 10B:
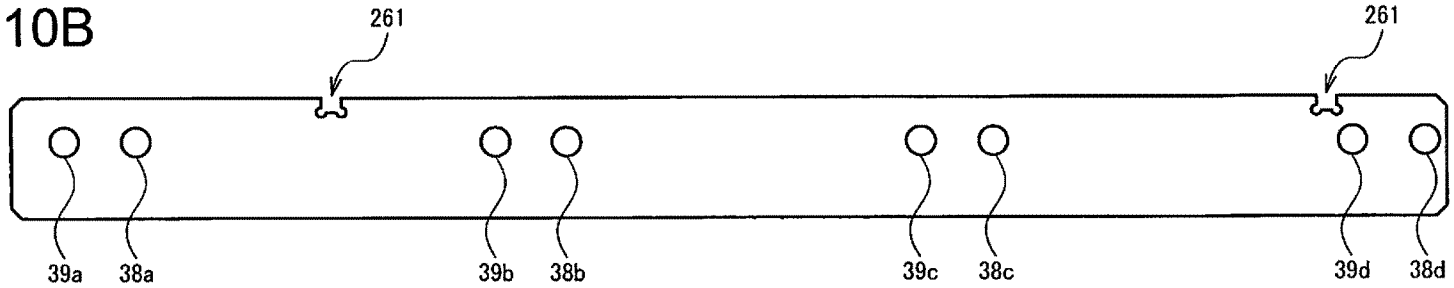
FIG. 10B shows positions of a pair of terminals on a first surface of the circuit substrate.

Specifically, each terminal out of the pairs of terminals provided on the circuit substrate 26 according to the present embodiment may have a circular shape as shown in FIG. 10B. Here, "circular shape" is not necessarily the shape of a true circle, and may be distorted to some extent. Also, the circumference of each terminal out of the pairs of terminals is not necessarily curved along the entire length, and may have, for example, the shape of a circle that has a recessed or projecting portion.

Each terminal can establish an electrical connection with the elastic contact 273 by coming into contact with the elastic contact 273 at any point (surface) inside the circular shape. In other words, the terminal can appropriately connect to the elastic contact 273 insofar as displacement is within the range of the circular shape.

With the pairs of terminals each configured to have a shape that has an equal size (distance) in any direction within the XY plane from a given point serving as a reference point, it is possible to realize terminals that can efficiently address displacement in any direction within the XY plane. Each terminal has the shape of a true circle when the distance from the reference point is exactly equal in any direction. However, even if the distance is slightly different in any direction, the effect of efficiently addressing displacement in the XY directions remains unchanged. In other words, it is advantageous that the pairs of terminals each have a substantially circular shape, and preferably have the shape of a true circle.

3. Details of Technique to Detect Liquid Surface Level

Next, a description is given of the technique to detect the liquid surface level. Specifically, a description is first given of an example of the configuration of a liquid detection unit 60. Note that the liquid detection unit 60 includes a component provided on the control substrate 15, a component provided on the circuit substrate 26 for detection, and a component provided on other portions (e.g., the pairs of electrically-conductive members). Therefore, a description is first given of the overall configuration of the liquid detection unit 60, and then a description is given of specific components provided on the circuit substrate 26 for detection. A description is also given of the details of the detection operation, with reference to Parts A to G of FIG. 14, for example.

3.1 Example of Configuration of Liquid Detection Unit

Figure 11:
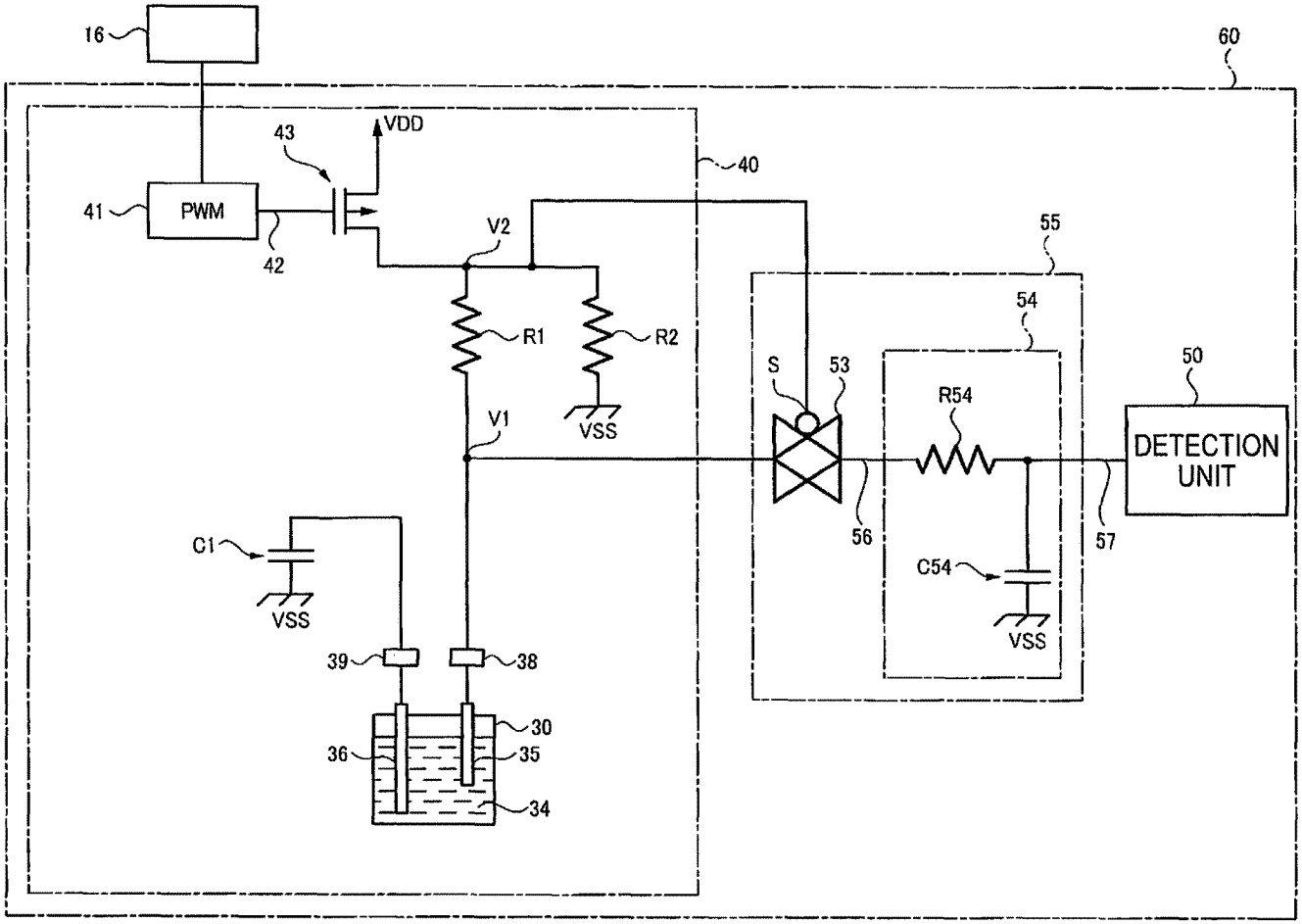
FIG. 11 shows an example of a configuration of a liquid detection unit.
Figure 12:
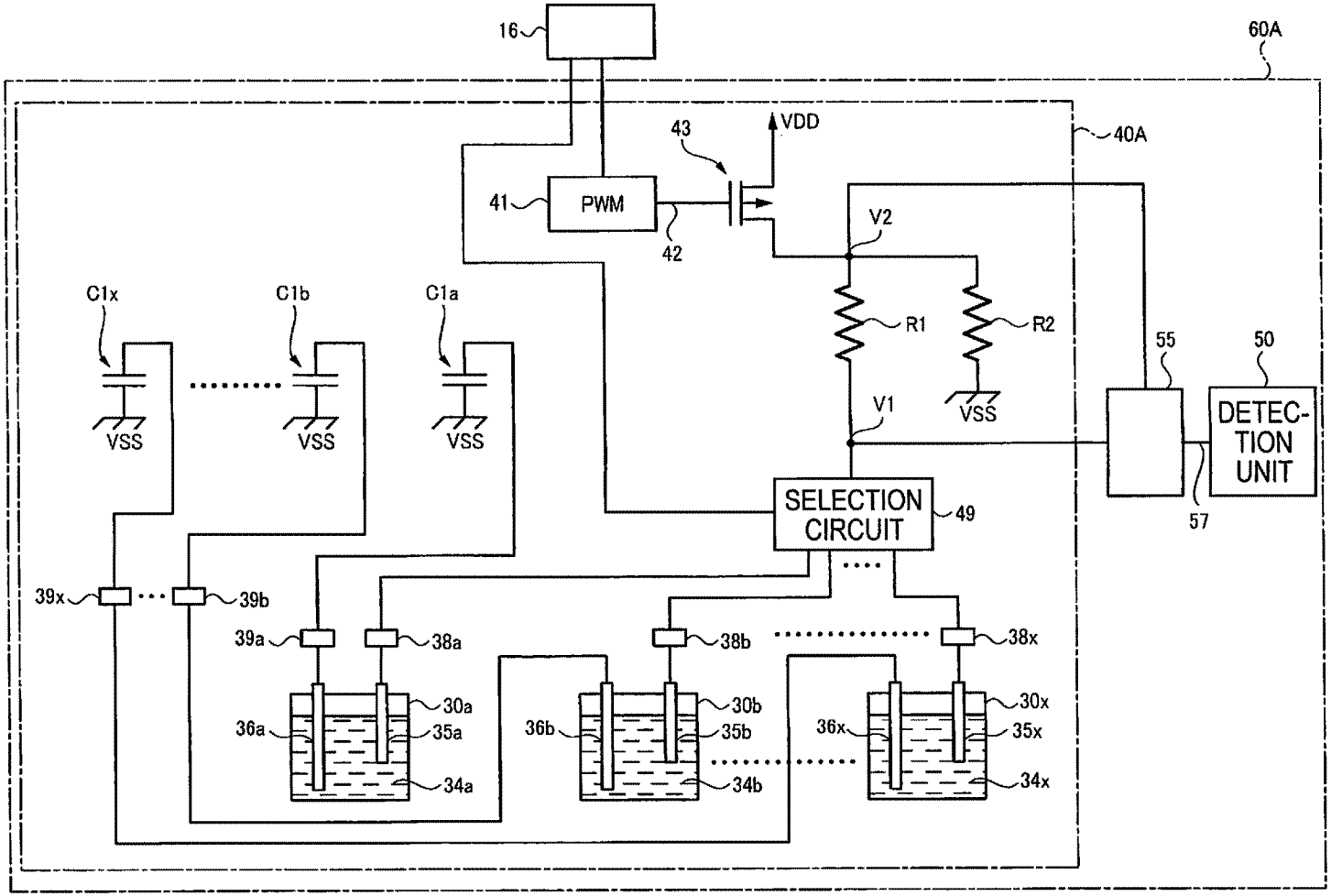
FIG. 12 shows another example of the configuration of the liquid detection unit.

The following describes the liquid detection unit 60 with reference to FIG. 11 and FIG. 12. FIG. 11 is a diagram showing an example of the liquid detection unit 60. In FIG. 11, VDD denotes the higher electric potential of a power supply that causes the liquid detection unit 60 to operate. VSS denotes the lower electric potential of the power supply, which is the reference electric potential (ground). The same signs are used in the subsequent drawings.

As shown in FIG. 11, the liquid detection unit 60 includes the alternating current generation circuit 40. As shown in FIG. 11, the alternating current generation circuit 40 includes: a first resistor R1 having one end connected to the first electrically-conductive member 35; a reference electric potential supply unit that includes at least one electrical element connected between the other end of the first resistor R1 and the reference electric potential VSS and that connects the first electrically-conductive member 35 to the reference electric potential VSS via the first resistor R1; and at least one capacitor connected between the second electrically-conductive member 36 and the reference electric potential VSS.

In the example shown in FIG. 11, the reference electric potential supply unit is constituted by a second resistor R2, and at least one capacitor connected between the second electrically-conductive member 36 and the reference electric potential VSS, which is mentioned above, corresponds to a capacitor C1.

The alternating current generation circuit 40 also includes a periodic signal generation unit 41 that generates a predetermined periodic signal, and a predetermined-electric potential supply unit that is connected to the other end of the first resistor R1 in the alternating current generation circuit (the end differing from the end connected to the first electrically-conductive member 35). In the example shown in FIG. 11, the predetermined-electric potential supply unit corresponds to a p-channel type FET 43. Although the details are described below with reference to Part B of FIG. 14, note that during a first interval within one cycle of the predetermined periodic signal, the predetermined-electric potential supply unit connects the first electrically-conductive member 35 to the predetermined electric potential VDD, which is higher than the reference electric potential VSS, via at least the first resistor R1, and during a second interval within one cycle, the predetermined-electric potential supply unit disconnects the connection between the first electrically-conductive member 35 and the predetermined electric potential VDD.

Also, as shown in FIG. 11, the liquid detection unit 60 includes a determination voltage generation unit 55 that generates a determination voltage used for detecting the liquid surface level, based on detection voltage that is based on the electric potential of the first electrically-conductive member 35.

The determination voltage generation unit 55 includes a smoothing circuit 54 that smooths detection voltage, and a switch circuit 53 that switches the output of the detection voltage to the smoothing circuit 54 ON and OFF. The smoothing circuit 54 includes a resistor R54 and a capacitor C54. The switch circuit 53 has a control terminal S, and switches to ON and OFF according to the state of the control terminal S.

The liquid detection unit 60 includes: the first electrically-conductive member 35 and the second electrically-conductive member 36; the first terminal 38 that connects the first electrically-conductive member 35 and the first resistor R1; and the second terminal 39 that connects the second electrically-conductive member 36 and the capacitor C1. The first electrically-conductive member 35 and the second electrically-conductive member 36 are provided in the ink tank 30. The first terminal 38 and the second terminal 39 are provided on the circuit substrate 26. The specific positions, etc., of the first terminal 38 and the second terminal 39 on the circuit substrate 26 is described below.

In the liquid detection unit 60, the alternating current generation circuit 40 generates a detection voltage V1, the determination voltage generation unit 55 generates a determination voltage by shaping the waveform of the detection voltage V1, and a detection unit 50 detects the presence or absence of the liquid between the pair of electrically-conductive members based on the determination voltage. The amount of the ink 34 is thus detected.

The above-described elements of the alternating current generation circuit 40 constitute the alternating current generation circuit 40 by being connected by wiring as shown in FIG. 11. Specifically, the source terminal of the p-channel type FET 43 is connected to VDD. The gate terminal of the p-channel type FET 43 is connected to a PWM output 42, which is the output from a periodic signal generation unit (also referred to as "PWM") 41. The first resistor R1 and the second resistor R2 are connected to the drain terminal of the p-channel type FET 43. One end of the first resistor R1 is connected to the first electrically-conductive member 35 via the first terminal 38, and the other end is connected to the drain terminal. One end of the second resistor R2 is connected to VSS, and the other end is connected to the drain terminal. The capacitor C1 is connected to the second electrically-conductive member 36. One end of the capacitor C1 is connected to VSS, and the other end is connected to the second electrically-conductive member 36 via the second terminal 39.

Note that the periodic signal generation unit 41 is constituted by a signal generator that can generate a periodic signal with various timings according to the control of the control unit 16 of the printer 1.

The determination voltage generation unit 55 transmits the detection voltage V1, which is generated by the alternating current generation circuit 40, to the smoothing circuit 54 with particular timing by using the switch circuit 53, and smooths the detection voltage V1 by using the smoothing circuit 54. The smoothed output from the smoothing circuit 54 serves as a detection output (determination voltage) 57 that is output by the detection unit 50. As shown in FIG. 11, the control terminal S of the switch circuit 53 is connected to a second connection point in the alternating current generation circuit 40, and the detection voltage V1 is transmitted to the smoothing circuit 54 based on an electric potential V2 at the second connection point. Here, the second connection point is the connection point of the drain terminal of the p-channel type FET 43 and the first resistor R1. One of the input and output terminals of the switch circuit 53 is connected to the first connection point in the alternating current generation circuit 40. The first connection point is the connection point of the first electrically-conductive member 35 and the first resistor R1, and the electric potential at the first connection point is the detection voltage V1. The other one of the input and output terminals of the switch circuit 53 is connected to one end of the resistor R54, which is input to the smoothing circuit 54. The other end of the resistor R54 is connected to the other end of the capacitor C54 having one end connected to VSS, and the resistor R54 and the capacitor C54 constitute the smoothing circuit 54. The electric potential at the connection point of the resistor R54 and the capacitor C54 is the detection output 57, which is the output from the smoothing circuit 54 and the output from the determination voltage generation unit 55.

Although the description above is given of an example of the case where a single liquid container (ink tank 30) is provided, the present embodiment is also applicable to a liquid consumption apparatus that has a plurality of liquid containers (the $1^{st}$ to $k^{th}$ liquid containers). In this case, the circuit substrate 26 is provided with a selection circuit 49 for supplying an alternating current voltage to the pair of electrically-conductive members provided for the liquid container selected from among the $1^{st}$ to $k^{th}$ liquid containers.

FIG. 12 shows an example of the configuration of the liquid detection unit 60 in the case where a plurality of liquid containers are provided. Specifically, FIG. 12 is a diagram showing a liquid detection unit 60A configured to include an alternating current generation circuit 40A, which is the alternating current generation circuit 40 in the case where a plurality of liquid containers are provided. The alternating current generation circuit 40A is a circuit in which the selection circuit 49 is added between the first resistor R1 and the first terminal 38 of the alternating current generation circuit 40 shown in FIG. 11. The selection circuit 49 is a multiplexer circuit that includes, for example, an analogue switch. The first electrically-conductive members 35 (35*a*, 35*b*, . . . , 35*x*) of the plurality of ink tanks 30 (30*a*, 30*b*, . . . , 30*x*) attached to the ink tank unit 20 are connected to the selection circuit 49 via the first terminals 38 (38*a*, 38*b*, . . . , 38*x*). The selection circuit 49 selects one of the plurality of first electrically-conductive members 35 (35*a*, 35*b*, . . . , 35*x*) connected thereto, according to the control of the control unit 16. The selected first electrically-conductive member 35 (e.g., 35*a*) is connected to the first resistor R1 by the selection circuit 49. On the other hand, the second electrically-conductive members 36 (36*a*, 36*b*, . . . , 36*x*) of the ink tanks 30 (30*a*, 30*b*, . . . , 30*x*) are respectively connected to the individual capacitors C1 (C1*a*, C1*b*, . . . , C1*x*) via the second terminals 39 (39*a*, 39*b*, . . . , 39*x*).

In other words, the alternating current generation circuit 40A includes the $1^{st}$ to $k^{th}$ capacitors C1 (C1*a*, C1*b*, . . . , C1*x*) each connected between the second electrically-conductive member side terminal (the second terminal 39) out of the corresponding pair among the $1^{st}$ to $k^{th}$ pairs of terminals, and the reference electric potential VSS.

Therefore, when the first electrically-conductive member 35*a* is selected by the selection circuit 49, the detection voltage V1 that can be used for detecting the ink information of the ink tank 30*a* can be generated by the same operation as the operation of the alternating current generation circuit 40 described above. As a result, the liquid detection unit 60 can detect the ink information of the ink tank 30*a*.

Similarly, when another first electrically-conductive member 35 (35*b*, . . . , 35*x*) is selected by the selection circuit 49, the ink information of the ink 34 stored in the ink tank 30 (30*b*, . . . , 30*x*) that corresponds to the selected first electrically-conductive member 35 (35*b*, . . . , 35*x*) can be detected.

With the configuration shown in FIG. 12, the ink level of the ink 34 in each of the plurality of ink tanks 30 attached to the ink tank unit 20 can be detected by using the single alternating current generation circuit 40A. Therefore, it is unnecessary to provide all the constituent elements of the alternating current generation circuit 40 (40A) for each ink tank 30, and the constituent elements of the alternating current generation circuit 40 (40A) can be shared among the ink tanks 30. As a result, the cost and the size of the liquid detection unit 60 (60A) can be reduced in the case where a plurality of ink tanks 30 are provided.

Furthermore, the capacitors C1 are separately connected to the respective second electrically-conductive members 36 of the plurality of ink tanks 30. Therefore, it is possible to position a capacitor C1 in the vicinity of each ink tank 30. As a result, wiring between the second electrically-conductive member 36 and the capacitor C1 can be easily installed, and the electrical properties can be stabilized.

3.2 Example of Positions of Circuit Elements of Circuit Substrate

Next, a description is given of a specific example of the positions of the circuit elements and so on of the circuit substrate 26, with reference to FIG. 10A and FIG. 10B. In the situation where the circuit substrate 26 is positioned to face the ink tanks 30 as shown in FIG. 2, and the surface of the circuit substrate 26 on the ink tanks 30 side is denoted as a first surface, and the surface opposite the first surface is denoted as a second surface, FIG. 10A shows an example of the configuration of the second surface, and FIG. 10B shows an example of the configuration of the first surface.

It is not necessary that all the elements of the alternating current generation circuit 40 be provided on the circuit substrate 26, and, as shown in FIG. 10A, at least some elements of the alternating current generation circuit 40 are provided thereon. In the example shown in FIG. 10A, from among the elements of the alternating current generation circuit 40, the first resistor R1, the second resistor R2, the selection circuit 49, and the determination voltage generation unit 55 (the switch circuit 53, and the resistor R54 and the capacitor C54 that constitute the smoothing circuit 54) are provided on the circuit substrate 26. The circuit substrate 26 also includes capacitors that are each connected between a second electrically-conductive member 36 and the reference electric potential VSS. Since FIG. 10A illustrates the circuit substrate 26 in the case where four ink tanks 30 are provided, four capacitors C1 (C1*a*, C1*b*, C1*c*, and C1*d*) are provided.

The circuit substrate 26 is also provided with a connector CN1 for connecting a flexible flat cable (the FFC 19). In this case, the determination voltage generation unit 55 is connected to the control unit 16 via the flexible flat cable, and the control unit 16 detects the liquid surface level based on the determination voltage (detection output 57) acquired via the flexible flat cable.

The selection circuit 49 is connected to the control unit 16 via the flexible flat cable, and the selection circuit 49 supplies the pair of electrically-conductive members, which are provided for the liquid container selected from among the plurality of liquid containers, with an alternating current voltage based on the selection signal received from the control unit 16 via the flexible flat cable. Specific control performed by the control unit 16 is described later with reference to Parts A to G of FIG. 14, and so on.

Also, as shown in FIG. 10B, a pair of terminals consisting of the first terminal 38 and the second terminal 39, which corresponds to the pair of electrically-conductive members (35 and 36) is positioned on the circuit substrate 26. When there are plurality of liquid containers, a pair of electrically-conductive members is provided for each liquid container. Therefore, the $1^{st}$ to $k^{th}$ pairs of terminals respectively corresponding to the $1^{st}$ to $k^{th}$ liquid containers (k is an integer greater than or equal to 2) that each have a pair of electrically-conductive members are positioned on the circuit substrate 26.

FIG. 10B, as with FIG. 10A, shows an example of the case where four ink tanks 30 are provided. Therefore, the circuit substrate 26 is provided with a first pair of terminals consisting of the first terminal 38*a* and the second terminal 39*a*, a second pair of terminals consisting of the first terminal 38*b* and the second terminal 39*b*, a third pair of terminals consisting of the first terminal 38*c* and the second terminal 39*c*, and a fourth pair of terminals consisting of the first terminal 38*d* and the second terminal 39*d*.

Note that from among the elements of the liquid detection unit 60, the elements not shown in FIG. 10A or FIG. 10B are provided on, for example, the control substrate 15 (main substrate) on which the control unit 16 is provided. For example, the periodic signal generation unit 41, and the p-channel type FET 43, which is the predetermined-potential supply unit, are positioned on the control substrate 15. However, note that the constitutional elements of the circuit substrate 26 and the control substrate 15 are not limited to the above, and various modifications may be adopted. For example, the periodic signal generation unit 41 and the p-channel type FET 43 may be provided on the circuit substrate 26.

3.3 Details of Liquid Surface Level Detection Operation

Figure 13:
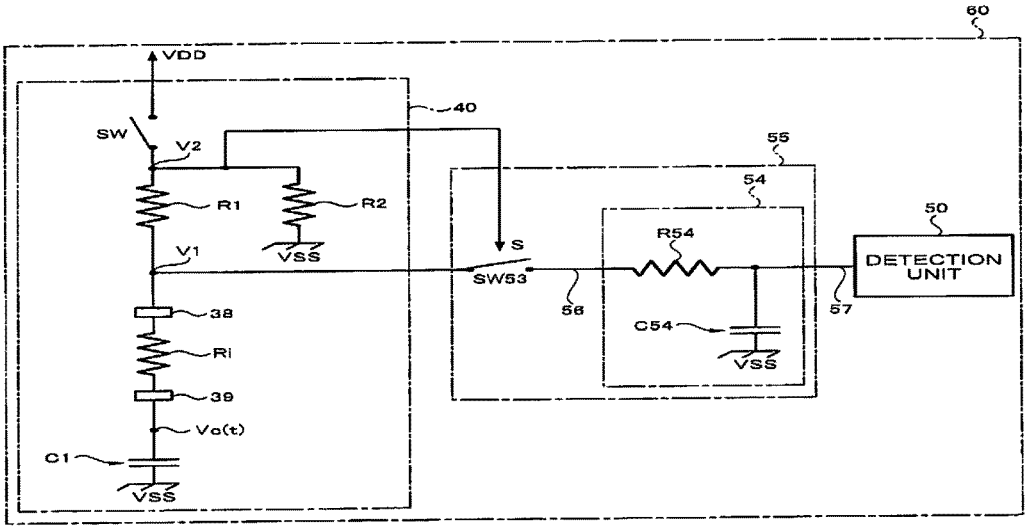
FIG. 13 is an equivalent circuit diagram of the liquid detection unit.
Figures 14A, 14B, 14C, 14D, 14E, 14F, 14G:
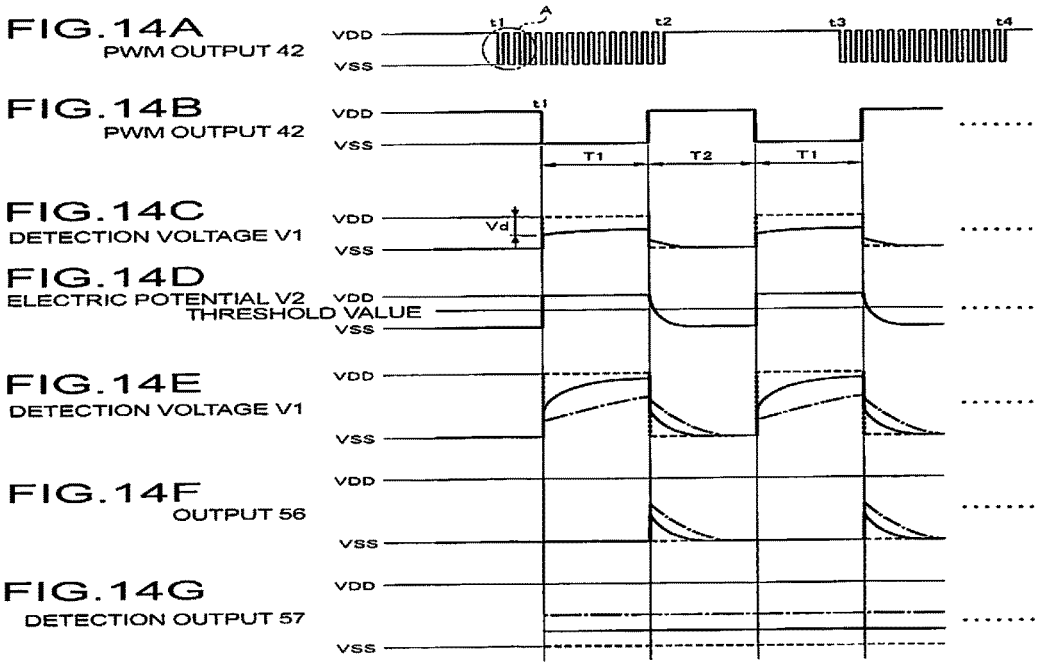
FIG. 14, which is composed of Parts A to G, is a timing chart showing an example of an operation of the liquid detection unit.

Next, a description is given of the details of the liquid surface level detection operation, with reference to FIG. 13 and FIG. 14. FIG. 13 is an equivalent circuit diagram of the liquid detection unit 60 shown in FIG. 11. Parts A to G of FIG. 14 constitute a timing chart showing an example of the operation of the liquid detection unit 60, and also show the electric potential of the detection voltage V1 and the electric potential of the detection output 57 based on the timing chart.

Both the PWM output 42 shown in Part A of FIG. 14 and the PWM output 42 shown in Part B of FIG. 14 indicate an output from the periodic signal generation unit 41. The PWM output 42 shown in Part B of FIG. 14 is a magnified view of a portion of the PWM output 42 shown in Part A of FIG. 14. Specifically, Part B of FIG. 14 is a magnified view of a range A that is surrounded by the two-dot chain line in the PWM output 42 shown in Part A of FIG. 14. In Part C of FIG. 14, the solid line indicates the detection voltage V1 that varies according to the operation of the alternating current generation circuit 40 described below, and the broken line indicates the detection voltage V1 when the ink 34 is absent. Part D of FIG. 14 shows the electric potential V2 at the second connection point, which controls the operations of the switch circuit 53. In Part E of FIG. 14, the solid line and the one-dot chain line indicate the detection voltages V1 each corresponding to a different type of the ink 34, and the broken line indicates the detection voltage V1 when the ink 34 is absent. Part F of FIG. 14 shows an output 56 from the switch circuit 53. Part G of FIG. 14 shows the detection output 57 (determination voltage).

The periodic signal generation unit 41 is controlled by the control signal from the control unit 16, with respect to the start and the stop of the oscillation of the periodic signal.

During a period for which the periodic signal generation unit 41 receives an oscillation instruction from the control unit 16, the periodic signal generation unit 41 outputs, as the PWM output 42, a signal in which a first interval T1 (VSS level) and a second interval T2 (VDD level) are periodically repeated. In Part A of FIG. 14, the interval from t1 to t2 and the interval from t3 to t4 are intervals for which the oscillation instruction from the control unit is being given. These intervals are collectively referred to as a periodic signal section. The time length of these intervals is set such that the detection unit can properly acquire the detection output 57 to determine the ink information (t1 to t4 indicate time points). For example, in the PWM output 42, the first interval T1 and the second interval T2 are periodically repeated at the same duty ratio (50%) during the periodic signal section.

Upon receiving an oscillation stop signal from the control unit 16, the periodic signal generation unit 41 stops the oscillation and outputs a signal at the VDD level as the output 42 (during the period from t2 to t3).

In the alternating current generation circuit 40 shown in FIG. 11, the p-channel type FET 43 is controlled to be turned ON or OFF based on the PWM output 42. Specifically, the p-channel type FET 43 is ON during the first interval T1 of the PWM output 42 (the gate terminal is at the VSS level), and is OFF during the second interval T2 (the gate terminal is at the VDD level). As a result, the drain terminal is at the VDD level during the first interval T1, and the drain terminal is in a high-impedance state during the second interval T2. Therefore, the first electrically-conductive member 35 is connected to VDD via the first resistor R1 during the first interval T1, and the connection is disconnected during the second interval T2. In this way, the p-channel type FET 43 functions as the predetermined-potential supply unit.

During the first interval T1, the second resistor R2 is also connected to VDD, and accordingly an electric current flows from VDD to VSS via the second resistor R2. Since this electric current increases the power consumed by the alternating current generation circuit 40, it is preferable to increase the value of the second resistor R2 as much as possible in order to prevent the increase in power consumption.

As described above, in a situation where the pair of electrically-conductive members, namely the first electrically-conductive member 35 and the second electrically-conductive member 36, are immersed in the ink 34, the pair of electrically-conductive members are electrically connected via the ink 34 having the ink resistance value Ri as shown in FIG. 13.

Accordingly, during the first interval T1, an electric current flows through the following passage: VDD→the p-channel type FET 43→the first resistor R1→the first terminal 38→the first electrically-conductive member 35→the ink→the second electrically-conductive member 36→the second terminal 39→the capacitor C1→VSS. When an electric current flows through this passage, the capacitor C1 is charged. Therefore, the electric potential of the capacitor C1 gradually approaches the VDD level, and during the first interval T1, as shown in Part C of FIG. 14, the detection voltage V1 gradually approaches the VDD level.

Subsequently, during the second interval T2, the p-channel type FET 43 is turned off. Therefore, no electric current flows from VDD, and the capacitor C1, which has been charged, has the highest electric potential within the circuit system. As a result, an electric current flows through the following passage: the capacitor C1→the second terminal 39→the second electrically-conductive member 36→the ink 34→the first electrically-conductive member 35→the first terminal 38→the first resistor R1→the second resistor R2→VSS. Electricity charged to the capacitor C1 is discharged during the first interval T1. Therefore, the second resistor R2 functions as the reference electric potential supply unit that connects the first electrically-conductive member 35 to VSS via the first resistor R1. At this time, the electric potential of the capacitor C1 gradually decreases along with electrical discharge. Therefore, as shown in Part C of FIG. 14, the detection voltage V1 gradually approaches the VSS level during the second interval T2.

As is clear from the above description, the direction in which the electric current passes through the ink 34 during the first interval T1 and the direction in which the electric current passes through the ink 34 during the second interval T2 are opposite. In other words, an alternating current passes through the ink 34 during the periodic signal section for which the first interval T1 and the second interval T2 of the PWM output 42 are periodically repeated.

Next, a description is given of the operation of the determination voltage generation unit 55 shown in FIG. 11. The electric potential V2, which controls the switch circuit 53, changes as shown in Part D of FIG. 14, based on the PWM output 42 shown in Part B of FIG. 14. Specifically, when the PWM output 42 is at the VDD level, the p-channel type FET 43 is OFF, and accordingly the electric potential V2 approaches the VSS level due to the second resistor R2. On the other hand, when the PWM output 42 is at the VSS level, the p-channel type FET 43 is ON, and accordingly the electric potential V2 is at the VDD level. The switch circuit 53 is configured to be turned OFF when the electric potential V2 rises above a predetermined threshold value and approaches the VDD level, and to be turned ON when the electric potential V2 falls below the predetermined threshold value and approaches the VSS level.

Therefore, during the second interval T2, in which the electric potential V2 approaches the VSS level, the detection voltage V1 is transmitted to the output 56 of the switch circuit 53. On the other hand, during the first interval T1, in which the electric potential V2 is at the VDD level, the transmission of the detection voltage V1 is blocked, and the output 56 comes into the undefined state. Part F of FIG. 14 shows this state, and specifically shows that the detection voltage V1 (Part E of FIG. 14) appears in the output 56 during the second interval T2.

Here, in Part E of FIG. 14, the solid line indicates the detection voltage V1 of a pigment based ink having a large ink resistance value Ri, and the one-dot chain line indicates the detection voltage V1 of a dye based ink having a smaller ink resistance value Ri than the pigment based ink. In this way, the detection voltage V1 has a different value according to the type of the ink 34, of which details are described below.

As described above, a portion of the detection voltage V1 is cut out based on changes in the electric potential V2, and serves as the output 56 from the switch circuit 53 (Part F of FIG. 14). Subsequently, the output 56 is transmitted to the smoothing circuit 54 and smoothed, and the detection output 57 is thus generated. As a result, as shown in Part G of FIG. 14, the detection output 57 that is stable and varies its electric potential level according to the type of the ink 34 is generated. Specifically, when two cases, namely the case in which there is a dye based ink and the case in which there is a pigment based ink, are considered, the dye based ink indicated by the one-dot chain line results in the generation of the detection output 57 with the highest electric potential, and the pigment based ink indicated by the solid line results in the generation of the detection output 57 with an electric potential that is lower than the electric potential of the detection output 57 of the dye based ink.

Therefore, due to the detection output 57 being detected by the detection unit 50 in the subsequent stage, it is possible to detect the presence of the ink 34 between the first electrically-conductive member 35 and the second electrically-conductive member 36. Furthermore, since the detection output 57 varies its electric potential level according to the type of the ink 34, it is also possible to detect the type of the ink 34 by, for example, providing the detection unit 50 with an A/D converter to grasp the difference in electric potential levels.

When the ink 34 has been consumed and the ink 34 is absent between the second electrically-conductive member 36 and the first electrically-conductive member 35, the first electrically-conductive member 35 and the second electrically-conductive member 36 are electrically disconnected and are brought into an isolated state. Therefore, during the first interval T1 for which the p-channel type FET 43 is ON, the detection voltage V1 is connected to VDD via the first resistor R1. On the other hand, during the second interval T2 for which the p-channel type FET 43 is OFF, the detection voltage V1 is connected to VSS via the first resistor R1 and the second resistor R2. As a result, as indicated by the broken line in Parts C and E of FIG. 14, the detection voltage V1 is at the VDD level during the first interval T1 and at the VSS level during the second interval T2. Consequently, as shown in Part G of FIG. 14, the detection output 57 is at the VSS level, and the absence of the ink 34 between the first electrically-conductive member 35 and the second electrically-conductive member 36 is detected.

Next, a more detailed description is given of the operation of the alternating current generation circuit 40 with reference to FIG. 13 and FIG. 14. In FIG. 13, SW is a switch and denotes the p-channel type FET 43. R1 denotes the first resistor R1, R2 denotes the second resistor R2, and Ri denotes the ink resistance value Ri of the ink 34. SW 53 is a switch and denotes the switch circuit 53.

In the case where both electrodes, namely the first electrically-conductive member 35 and the second electrically-conductive member 36, are immersed in the ink 34, when SW is turned ON, C1 is connected to VDD via R1 and Ri, and an electric current flows. The detection voltage V1 in this case can be expressed by equation (1) below.

$$V1=VDD-(R1/(R1+Ri))\times(VDD-Vc(t)) \quad (1)$$

Note that Vc(t) denotes the electric potential of C1. (t) denotes a parameter, and indicates that Vc(t) changes along with the progress of time t.

During the first interval T1, C1 is charged by VDD, and Vc(t) gradually increases along with the progress of time. As a result, "(VDD−Vc(t))", which is the third term on the right-hand side of equation (1), gradually decreases, and accordingly the value subtracted from "VDD", which is the first term on the right-hand side, decreases. Thus, as indicated by the detection voltage V1 in Part C of FIG. 14, the detection voltage V1 gradually approaches the VDD level. Therefore, an electric potential difference Vd between the VDD level and the detection voltage V1 gradually decreases.

Here, if C1 has been sufficiently charged and Vc(t1)=0 at time t1, which is the starting time of the first interval T1, equation (2) below can be obtained by substituting this value into equation (1) above.

$$V1=(Ri/(R1+Ri))\times VDD \quad (2)$$

That is, the detection voltage V1 gradually increases from the initial value, which is the value expressed by equation (2), and approaches the VDD level, and accordingly the electric potential difference Vd gradually decrease.

Also, as can be seen from equation (2) above, the initial value of the detection voltage V1 is greater for a greater Ri. Therefore, at time t1, as shown in Part E of FIG. 14, the detection voltage V1 of the pigment based ink having a large Ri, which is indicated by the solid line, takes a larger value than the detection voltage V1 of the dye based ink having a small Ri, which is indicated by the one-dot chain line.

During the second interval T2, electric charge is discharged from C1, which has been charged during the first interval T1, to VSS, via Ri, R1, and R2. Therefore, Vc(t) gradually decreases, and as shown in Parts C and E of FIG. 14, the detection voltage V1 gradually decreases and reaches the VSS level. Here, if Ri is large, charging does not progress and Vc(t) does not become large because the charging electric current applied to C1 during the first interval T1 is small. In other words, in the case of the dye based ink, which has a smaller Ri than the pigment based ink, the charging of C1 progresses further and Vc(t) becomes larger. Therefore, as shown in Part E of FIG. 14, when the discharging of C1 is started in the second interval T2, the detection voltage V1 of the dye based ink having a small Ri, which is indicated by the one-dot chain line, takes a larger value than the detection voltage V1 of the pigment based ink having a large Ri, which is indicated by the solid line.

As described above, the liquid detection unit 60 can generate a different detection output 57 according to the type of the ink 34, and can detect the ink information such as the presence or absence of the ink 34 and the type of the ink 34.

Also, as can be seen from FIG. 3, when the ink 34 has been consumed and the amount of the ink 34 decreases, first, the tip of the first electrically-conductive member 35 shorter than the second electrically-conductive member 36 is separated from the interface of the ink 34. The amount of the ink 34 at this time is uniquely determined from the size of the hollow part of the ink tank 30 and the length of the first electrically-conductive member 35. Therefore, when it is detected that the ink 34 is absent between the first electrically-conductive member 35 and the second electrically-conductive member 36, it is possible to know the amount of the remaining ink 34.

If the first interval T1 increases, or the value of the first resistor R1 decreases, or the value of the capacitor C1 decreases, the electric potential of the capacitor C1 gets more closer to the VDD level during the first interval T1. As a result, no current flows from the VDD to the capacitor C1. The state in which no current flows is the same as the state in which the ink 34 is absent, and it is difficult to detect the presence or absence of the ink 34. For this reason, it is preferable that the length of the first interval T1 (in other words, the periods of the first interval T1 and the second interval T2 of the PWM output 42), the value of the first resistor R1, and the value of the capacitor C1 are determined such that when both electrodes, namely the first electrically-conductive member 35 and the second electrically-conductive member 36, are immersed in the ink 34, a current always flows from the VDD to the capacitor C1 and there is an electric potential difference Vd during the first interval T1.

As described above, according to the present embodiment, the alternating current generation circuit 40 of the liquid detection unit 60 can apply an alternating current to the ink 34. Therefore, it is possible to realize the liquid detection unit 60 that does not allows bubbles or the deposition of ink components on the first electrically-conductive member 35 or the second electrically-conductive member 36 to occur due to electrolysis when detecting the ink information.

Furthermore, it is possible to realize the alternating current generation circuit 40 that generates the detection voltage V1 that, when the ink 34 is present, always has the electric potential difference Vd from the VDD level during the first interval, and when the ink 34 is absent, has the electric potential difference Vd that is 0 during the first interval. Also, it is possible to realize the determination voltage generation unit 55 that generates the detection output 57 used for detecting the presence or absence and the type of the ink 34 based on the detection voltage V1. Therefore, with the liquid detection unit 60 that is configured to include the alternating current generation circuit 40, the determination voltage generation unit 55, and the detection unit 50 that detects the detection output 57, the printer 1 can detect the ink information without allowing bubbles or the deposition of ink components on the electrodes to occur due to electrolysis.

Furthermore, in the alternating current generation circuit 40 of the liquid detection unit 60, the first electrically-conductive member 35 is connected to the first resistor R1 via the first terminal 38, and the second electrically-conductive member 36 is connected to the capacitor C1 via the second terminal 39, and accordingly it is easy to disconnect each terminal part from the corresponding electrode. Therefore, it is possible to adopt a configuration in which, when the ink tank 30 is connected to the ink tank unit 20 and to the printer 1 accordingly, the first electrically-conductive member 35 is connected to the first terminal 38 and the second electrically-conductive member 36 is connected to the second terminal 39. As a result, it is possible to realize the liquid detection unit 60 with which the ink tank 30 can be attached to and detached from the printer 1 and that can establish a reliable connection when the ink tank 30 is attached, and to realize the printer 1 provided with the liquid detection unit 60.

Furthermore, as shown in FIG. 11, in the alternating current generation circuit 40 of the liquid detection unit 60, the p-channel type FET 43 serving as the predetermined-potential supply unit and the second resistor R2 serving as the reference electric potential supply unit can be connected with each other via a single wiring line. Therefore, it is easy to dispersedly position the predetermined-potential supply unit and the reference electric potential supply unit on different circuit substrates. For example, the control unit 16, the periodic signal generation unit (PWM) 41, and the p-channel type FET 43 may be positioned on the control substrate 15 of the printer 1, while the first resistor R1, the second resistor R2, the first terminal 38, the second terminal 39, and the capacitor C1 may be positioned on the circuit substrate 26 on the ink tank unit 20 side, and the p-channel type FET 43 and the second resistor R2 may be connected via the signal wiring FFC 19. The constituent elements of the alternating current generation circuit 40 can be thus dispersedly positioned on different circuit substrates with minimal wiring, and it is possible to improve the flexibility in designing the substrate layout, while preventing an increase in the cost.

Furthermore, by appropriately determining the period of the periodic signal of the PWM output 42, the value of the first resistor R1, and the value of the capacitor C1, it is possible to set the alternating current generation circuit 40 of the liquid detection unit 60 such that when both electrodes, namely the first electrically-conductive member 35 and the second electrically-conductive member 36, are immersed in the ink 34, an electric current always flows from the VDD to the capacitor C1 via the first resistor R1 and the ink 34 during the first interval T1. As a result, the detection voltage V1 can be set to always have the electric potential difference Vd from the VDD level. Therefore, due to the detection unit 50 detecting the detection output 57 generated by the determination voltage generation unit 55 based on the detection voltage V1, it is possible to detect the ink information such as the presence Or absence and the type of the ink 34.

Furthermore, as the PWM output 42, it is possible to use a signal that intermittently has a periodic signal in which the first interval T1 and the second interval T2 are periodically repeated, and that is at the same electric potential level as that in the second interval T2 during intervals in which the periodic signal is present. Therefore, the capacitor C1, which is charged or discharges during intervals in which the periodic signal is present, can satisfactorily discharge during intervals in which the periodic signal is absent. As a result, it is possible to set the electric potential of the capacitor C1 to be a constant value at the time when the periodic signal starts, and accordingly it is possible to realize the alternating current generation circuit 40 that generates the detection voltage V1 that is stable, and furthermore, it is possible to realize the liquid detection unit 60 that performs stable operations.

Also, the determination voltage generation unit 55 of the liquid detection unit 60 can be configured with the switch circuit 53 and the smoothing circuit 54. Therefore, the detection voltage V1, which is generated during the first interval T1 and the second interval T2, can be selected by the switch circuit 53 with time division. Furthermore, the detection output 57 having a stable electric potential level is generated by the smoothing circuit 54 from the selected detection voltage V1. As a result, the detection output 57 can be detected at any time, and it is possible to improve the flexibility in designing the products.

Also, the determination voltage generation unit 55 can be configured with the switch circuit 53 and the smoothing circuit 54 that is configured with passive elements. Therefore, compared to the case where the determination voltage generation unit 55 is configured with a single MOSFET or a bipolar transistor, a stable detection output 57 can be generated without the influence of variations in the threshold value (Vth) of the MOSFET or variations in the direct current amplification rate (hfe) of the bipolar transistor.

Also, with the determination voltage generation unit 55 configured to generate the detection output 57 during the second interval T2, it is possible to generate the detection output 57 according to the type of ink when the ink 34 is present, and to set the detection output 57 to be at the VSS level when the ink 34 is absent. Therefore, it is possible to make a distinction from a failure mode in which the detection output 57 is at the VSS level despite the presence of the ink 34.

Furthermore, the printer 1 is provided with the liquid detection unit 60 according to the present embodiment. Since the ink tank 30 with which the liquid detection unit 60 is configured is provided with the ink injection port 32, the printer 1 can be refilled with the ink 34.

4. Modification Examples

Figure 15:
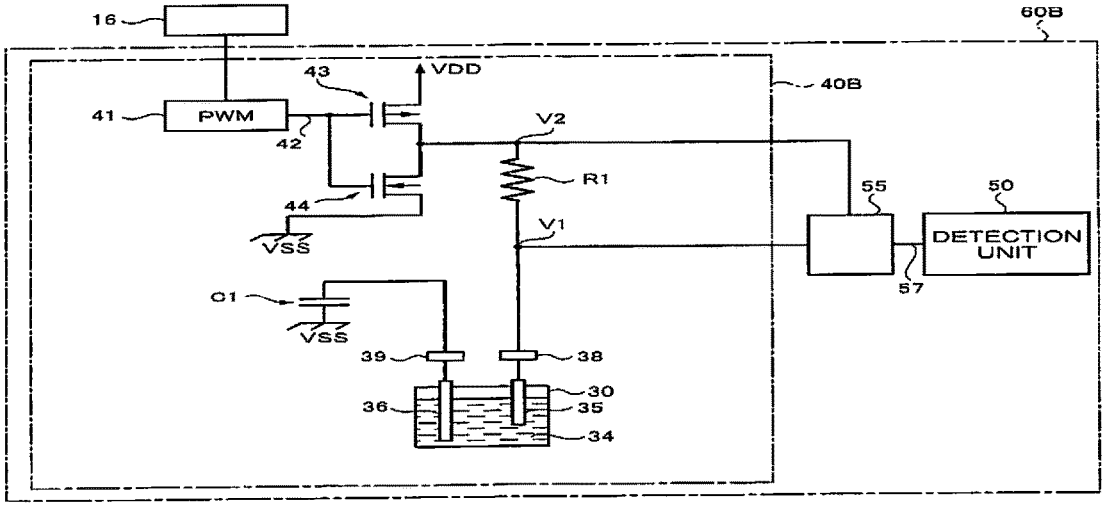
FIG. 15 shows another example of the configuration of the liquid detection unit.

FIG. 15 is a diagram showing another modification example of the liquid detection unit 60. Specifically, FIG. 15 is a diagram showing a liquid detection unit 60B configured to include an alternating current generation circuit 40B, which is another modification example of the alternating current generation circuit 40 shown in FIG. 11. The alternating current generation circuit 40B is a circuit in which the second resistor R2 of the alternating current generation circuit 40 is replaced with an n-channel type FET 44, which is connected to the p-channel type FET 43 so as to be of the complementary type. With this configuration, during the first interval T1 of the PWM output 42, the p-channel type FET 43 serving as the predetermined-potential supply unit is turned ON, and the n-channel type FET 44 is turned OFF. Therefore, an electric current flows through the capacitor C1 via the first resistor R1 and the ink 34. During the second interval T2 of the PWM output 42, the p-channel type FET 43 is OFF and the n-channel type FET 44 serving as the reference electric potential supply unit is ON. Therefore, an electric current flows from the capacitor C1, which has been charged during the first interval T1, via the ink 34 and the first resistor R1.

Therefore, it is possible to generate the detection voltage V1 from which the ink information of the ink 34 can be detected, in the same manner as the operation of the alternating current generation circuit 40 described above.

Thus, the predetermined-potential supply unit can be configured with a single p-channel type FET 43, and the reference electric potential supply unit can be configured with a single n-channel FET 44. Thus, the alternating current generation circuit 40 (40B) can be configured with a small number of electrical elements, and the cost and the size of the liquid detection unit 60 (60B) can be reduced.

Although a description is given of the case where the first electrically-conductive member 35 and the second electrically-conductive member 36 are made from a stainless material having the shape of a flattened rod, the material of the first electrically-conductive member 35 and the second electrically-conductive member 36 are not limited to this. Any electrically-conductive materials can be adopted, and materials that will be not subject to corrosion and will not cause rust to mix into the ink 34 are preferable. For example, a carbon material may be used. Also, the shape is not limited to the shape of a flattened rod, and may be the shape of a round rod, a rectangular rod, a coil, and so on.

Also, in the embodiment above, although a description is given of the case where the duty ratio of the first interval T1 and the second interval T2 of the PWM output 42 is 50%, the duty ratio may be varied, and the second interval T2 may be set to be longer than the first interval T1. Thus, the period during which the capacitor C1 is charged can be set to be longer than the period during which the capacitor C1 discharges. Thus, the electric charge stored in the capacitor C1 during the first interval T1 can be satisfactorily discharged during the second interval T2, and accordingly the electric potential of the capacitor C1 at the time when the second interval T2 ends and the first interval T1 starts can be maintained at a constant value.

In the above-described embodiment, the ink information is detected by detecting the detection output 57 during the second interval T2. Meanwhile, during the first interval T1, the value of the detection voltage V1 varies according to the presence or absence and the type of the ink 34 between the first electrically-conductive member 35 and the second electrically-conductive member 36. Therefore, the detection output 57 may be detected during the first interval T1. Furthermore, the ink information may be detected from the value of difference between the detection output 57 detected during the first interval T1 and the detection output 57 detected during the second interval T2.

In the embodiment and modification example above, the ink 34 stored in the ink tanks 30 is described as an example of the liquid stored in the liquid containers, and the inkjet printer 1 is described as an example of the liquid consumption apparatus. However, the applicable scope of the present embodiment is not limited to this, and the present embodiment is applicable to a liquid consumption apparatus that can detect the liquid information of an electrically-conductive liquid stored in a liquid container and that can inject the liquid.

While the present embodiment has been described above in detail, a person skilled in the art should easily understand that many modifications are possible without substantially departing from new matters and effects of the invention. Therefore; all examples of such modifications are to be embraced within the scope of the invention. For example, terms that are used at least once in the description or the drawings in conjunction with different terms having broader or similar meanings can be replaced with different terms in any portion of the description or the drawings. Furthermore, the configurations and operations of the liquid consumption apparatus are not limited to those described in the present embodiment, and can be implemented with various modifications.

According to the description of the present embodiment, the ink tanks 30 (liquid containers) housed in the ink tank unit 20 are attached to the printer 1 by the printer vendor, and when the ink 34 is absent in an ink tank 30, the user of the printer 1 refills the ink tank 30 with ink from the ink injection port 32 without replacing the ink tank 30. The application of the present invention is not limited to this, and the ink tanks 30 may be configured to be able to be attached to or detached from the printer 1 by the user of the printer 1, and when the ink 34 in an ink tank 30 has been consumed, it may be replaced with a new ink tank 30. If this is the case, the ink tank 30 does not have the ink injection port 32, and the ink supply part 33 may have a valve that is configured to be able to be opened and closed. Then, the first electrically-conductive member 35 and the second electrically-conductive member 36 of the ink tank 30 may be connected to the terminals 38 and 39 of the circuit substrate 26 when the ink tank 30 is attached to the printer 1.

In the embodiment above, although a description is given of the case where the control unit 16 detects the liquid surface level inside the liquid container that has a single hollow part, liquid surface level detection is not limited to this. For example, when the liquid container has a plurality of chambers that are connected to each other with flow channels, liquid surface level detection is to detect the presence or absence of the liquid in the area where the pair of electrically-conductive members are positioned. In other words, liquid surface detection is to detect whether the amount of remaining liquid in the liquid container is equal to a predetermined amount or smaller.

The entire disclosure of Japanese Patent Application No. 2015-057512, filed on Mar. 20, 2015 is expressly incorporated herein by reference.

What is claimed is:

1. A liquid consumption apparatus that detects a liquid surface level of a liquid inside each of $1^{st}$ to $k^{th}$ liquid containers, where k is an integer greater than or equal to 4, comprising:

a circuit substrate; and a control unit that detects the liquid surface level, wherein each of the liquid containers is provided with a pair of electrically-conductive members including a first electrically-conductive member and a second electrically-conductive member, the circuit substrate is provided with $1^{st}$ to $k^{th}$ pairs of terminals corresponding to the $1^{st}$ to $k^{th}$ liquid containers each of which is provided with the pair of electrically-conductive members, the circuit substrate is provided with a selection circuit configured and arranged to supply an alternating current voltage to the pair of electrically-conductive members provided for a liquid container selected from among the $1^{st}$ to $k^{th}$ liquid containers, and the selection circuit is positioned in an area of the circuit substrate corresponding to a space between $i^{th}$ pair of terminals and $i+1^{th}$ pair of terminals among the $1^{st}$ to $k^{th}$ pairs of terminals on the circuit substrate, where i is an integer which satisfies $2 \leq i \leq k-2$.

2. The liquid consumption apparatus according to claim 1, further comprising a substrate holder that holds the circuit substrate, wherein the substrate holder is fixed to the liquid containers with fixing members.

3. The liquid consumption apparatus according to claim 1, wherein the circuit substrate is provided with at least a portion of an alternating current generation circuit configured to be able to supply an alternating current voltage to the liquid inside the liquid containers via the pairs of electrically-conductive members provided for the liquid containers.

4. The liquid consumption apparatus according to claim 3, wherein the alternating current generation circuit includes:

a first resistor having one end that is connected to the first electrically-conductive member;

a reference electric potential supply unit that includes at least one electrical element connected between the other end of the first resistor and a reference electric potential, and that connects the first electrically-conductive member to the reference electric potential via the first resistor; and at least one capacitor connected between the second electrically-conductive member and the reference electric potential, wherein the circuit substrate is provided with at least the first resistor, the reference electric potential supply unit, and the capacitor.

5. The liquid consumption apparatus according to claim 4, wherein the alternating current generation circuit includes:

a periodic signal generation unit that generates a predetermined periodic signal; and a predetermined-electric potential supply unit connected to the other end of the first resistor of the alternating current generation circuit, and the predetermined-electric potential supply unit connects the first electrically-conductive member to a predetermined electric potential that is higher than the reference electric potential via at least the first resistor during a first interval within one cycle of the predetermined periodic signal, and disconnects a connection between the first electrically-conductive member and the predetermined electric potential during a second interval within the one cycle of the predetermined periodic signal.

6. The liquid consumption apparatus according to claim 1, wherein the circuit substrate is provided with a determination voltage generation unit that generates a determination voltage used for detecting the liquid surface level based on a detection voltage that is based on an electric potential of the first electrically-conductive member.

7. The liquid consumption apparatus according to claim 6, wherein the determination voltage generation unit includes:

a smoothing circuit that smooths the detection voltage; and a switch circuit that switches an output of the detection voltage to the smoothing circuit ON and OFF.

8. The liquid consumption apparatus according to claim 6, wherein the circuit substrate is provided with a connector that connects a flexible flat cable, the determination voltage generation unit is connected to the control unit via the flexible flat cable, and the control unit detect the liquid surface level based on the determination voltage acquired via the flexible flat cable.

9. The liquid consumption apparatus according to claim 8, wherein the selection circuit is connected to the control unit via the flexible flat cable, and the selection circuit supplies the alternating current voltage to the pair of electrically-conductive members provided for a liquid container selected from among the $1^{st}$ to $k^{th}$ liquid containers based on a selection signal received from the control unit via the flexible flat cable.

10. The liquid consumption apparatus according to claim 1, wherein the selection circuit is an analogue switch.

* * * * *